US009303468B2

(12) United States Patent
Selzer et al.

(10) Patent No.: US 9,303,468 B2
(45) Date of Patent: Apr. 5, 2016

(54) DRILLING SYSTEM AND A DEVICE FOR ASSEMBLING AND DISASSEMBLING PIPE STANDS

(75) Inventors: Per Andre Selzer, Koge (DK); Magnus Johansson, Kristiansand S (NO); Erik Haavind, Kristiansand S (NO); Jonathan Garrick Webb, Kristiansand (NO); Trond Werner Moen, Kristiansand S (NO); Bjorn Abrahamsen, Kristiansand S (NO)

(73) Assignee: NATIONAL OILWELL VARCO NORWAY AS, Kristiansand (NO)

( * ) Notice: Subject to any disclaimer, the term of this patent is extended or adjusted under 35 U.S.C. 154(b) by 416 days.

(21) Appl. No.: 13/880,924

(22) PCT Filed: Nov. 2, 2011

(86) PCT No.: PCT/US2011/058969

§ 371 (c)(1),
(2), (4) Date: Apr. 22, 2013

(87) PCT Pub. No.: WO2012/061506

PCT Pub. Date: May 10, 2012

(65) Prior Publication Data

US 2013/0206478 A1 Aug. 15, 2013

Related U.S. Application Data

(60) Provisional application No. 61/409,459, filed on Nov. 2, 2010.

(51) Int. Cl.

| | |
|---|---|
| ***E21B 19/06*** | (2006.01) |
| ***E21B 19/14*** | (2006.01) |
| ***E21B 19/16*** | (2006.01) |

(52) U.S. Cl.
CPC ..... *E21B 19/06* (2013.01); *E21B 19/14* (2013.01); *E21B 19/16* (2013.01); *E21B 19/165* (2013.01)

(58) Field of Classification Search
CPC ..... E21B 19/06; E21B 19/16; E21B 19/165; E21B 19/14; E21B 19/146; E21B 19/20; E21B 19/155
See application file for complete search history.

(56) References Cited

U.S. PATENT DOCUMENTS

| | | | |
|---|---|---|---|
| 2,321,245 | A | 6/1943 | Reed |
| 2,999,549 | A | 9/1961 | Hal |

(Continued)

FOREIGN PATENT DOCUMENTS

| | | | |
|---|---|---|---|
| CN | 201016283 | Y | 2/2008 |
| DE | 19648675 | A1 | 5/1998 |

(Continued)

OTHER PUBLICATIONS

Korean Office Action dated Jun. 26, 2014; Korean Application No. 10-2013-7014143 (3 p.).

(Continued)

*Primary Examiner* — Yong-Suk (Philip) Ro
(74) *Attorney, Agent, or Firm* — Conley Rose, P.C.

(57) ABSTRACT

A system for storing one or more tubulars comprises a drilling deck including a hole offset from a wellbore centerline. In addition, the system comprises a rack unit coupled to the drilling deck and extending downward from the hole in the drilling deck. The rack unit comprises a tubular housing having a longitudinal axis, an upper end, and a lower end opposite the upper end. The rack unit also comprises a first rack disposed within the body, wherein the first rack is moveably coupled to the body.

29 Claims, 13 Drawing Sheets

(56) References Cited

U.S. PATENT DOCUMENTS

| | | | |
|---|---|---|---|
| 3,039,757 | A | 6/1962 | Barr |
| 3,252,548 | A | 5/1966 | Peter et al. |
| 3,371,728 | A | 3/1968 | Curtis et al. |
| 3,376,031 | A | 4/1968 | Lee |
| 3,552,525 | A | 1/1971 | Schudel |
| 3,689,060 | A | 9/1972 | Hensley, Jr. |
| 3,851,911 | A | 12/1974 | Brooks |
| 3,966,054 | A | 6/1976 | Kelly |
| 3,981,369 | A | 9/1976 | Bokenkamp |
| 4,044,895 | A | 8/1977 | Adair |
| 4,050,590 | A | 9/1977 | Benjamin |
| 4,071,145 | A | 1/1978 | Guinn et al. |
| 4,505,614 | A | 3/1985 | Anschutz |
| 4,708,563 | A | 11/1987 | Van Den Berg et al. |
| 4,762,185 | A | 8/1988 | Simpson |
| 4,880,088 | A | 11/1989 | De Oliveira |
| 5,107,705 | A | 4/1992 | Wraight et al. |
| 5,131,470 | A | 7/1992 | Miszewski et al. |
| 5,167,299 | A | 12/1992 | Nusbaum |
| 5,247,897 | A | 9/1993 | Pepp |
| 5,351,767 | A | 10/1994 | Stogner et al. |
| 5,419,416 | A | 5/1995 | Miyashita et al. |
| 5,468,121 | A | 11/1995 | Stogner |
| 5,595,248 | A | 1/1997 | Denny |
| 6,004,066 | A | 12/1999 | Niemerski |
| 6,024,383 | A | 2/2000 | Foehl |
| 6,209,851 | B1 | 4/2001 | Eilertsen |
| 6,343,892 | B1 | 2/2002 | Kristiansen |
| 6,394,186 | B1 | 5/2002 | Whitelaw et al. |
| 6,439,358 | B1 | 8/2002 | Brueck et al. |
| 6,460,667 | B1 | 10/2002 | Brueck et al. |
| 6,513,605 | B1 | 2/2003 | Loedden |
| 6,976,540 | B2 | 12/2005 | Berry |
| 7,083,007 | B2 | 8/2006 | Herst |
| 7,111,676 | B2 | 9/2006 | Drzewiecki |
| 7,143,848 | B2 | 12/2006 | Armell |
| 7,228,919 | B2 | 6/2007 | Fehres et al. |
| 7,677,856 | B2 | 3/2010 | Standal |
| 7,736,119 | B2 | 6/2010 | Belik |
| 7,841,415 | B2 | 11/2010 | Winter |
| RE41,988 | E | 12/2010 | Oberth et al. |
| 8,052,370 | B2 | 11/2011 | Dekker et al. |
| 8,245,773 | B2 | 8/2012 | Webb |
| 8,844,688 | B2 | 9/2014 | Pedersen |
| 2002/0023749 | A1 | 2/2002 | Kirk et al. |
| 2006/0108113 | A1 | 5/2006 | Scott et al. |
| 2007/0251728 | A1 | 11/2007 | Belik |
| 2008/0164064 | A1 | 7/2008 | Belik et al. |
| 2008/0283303 | A1 | 11/2008 | Cote |
| 2008/0304939 | A1* | 12/2008 | Dekker et al. ..... 414/22.63 |
| 2009/0053015 | A1 | 2/2009 | Zachariasen et al. |
| 2011/0226574 | A1 | 9/2011 | Chen et al. |
| 2012/0175326 | A1 | 7/2012 | Lunde |
| 2013/0206388 | A1 | 8/2013 | Webb et al. |

FOREIGN PATENT DOCUMENTS

| | | | |
|---|---|---|---|
| EP | 0449710 | A2 | 10/1991 |
| EP | 1103696 | A2 | 5/2001 |
| GB | 2011019 | A | 7/1979 |
| GB | 1558172 | A | 12/1979 |
| GB | 2071734 | A | 9/1981 |
| GB | 2137261 | A | 10/1984 |
| GB | 2160564 | A | 12/1985 |
| GB | 2276697 | A | 10/1994 |
| NO | 322116 | B1 | 8/2006 |
| NO | 20054697 | A | 4/2007 |
| WO | 01/33029 | A2 | 5/2001 |
| WO | 2006/059910 | A1 | 6/2006 |
| WO | 2006068497 | A1 | 6/2006 |
| WO | 2006096068 | A1 | 9/2006 |
| WO | 2007043891 | A1 | 4/2007 |
| WO | 2007/100259 | A1 | 9/2007 |
| WO | 2008/035977 | A1 | 3/2008 |

OTHER PUBLICATIONS

English Summary of Korean Office Action dated Jun. 26, 2014; Korean Application No. 10-2013-7014143 (4 p.).

PCT/NO2006/000352 International Search Report and Written Opinion dated Jan. 19, 2007 (9 p.).

U.S. Office Action dated Jun. 25, 2009; U.S. Appl. No. 12/089,484 (8 p.).

U.S. Response to Office Action Dated Jun. 25, 2009; U.S. Appl. No. 12/089,484; Response filed Sep. 17, 2009 (4 p.).

U.S. Notice of Allowance dated Jan. 14, 2010; U.S. Appl. No. 12/089,484 (6 p.).

U.S. Office Action dated Jun. 17, 2011; U.S. Appl. No. 12/311,010 (17 p.).

U.S. Response to Office Action Dated Jun. 17, 2011; U.S. Appl. No. 12/311,010; Response dated Sep. 15, 2011 (15 p.).

U.S. Notice of Allowance dated Apr. 23, 2012; U.S. Appl. No. 12/311,010 (10 p.).

PCT/NO2009/000369 International Search Report and Written Opinion dated Jan. 22, 2010 (6 p.).

U.S. Office Action dated Nov. 7, 2013; U.S. Appl. No. 13/126,729 (6 p.).

U.S. Response to Office Action Dated Nov. 7, 2013; U.S. Appl. No. 13/126,729; Response Filed Feb. 6, 2014 (10 p.).

U.S. Final Office Action dated Feb. 27, 2014; U.S. Appl. No. 13/126,729 (6 p.).

U.S. Response to Final Office Action Dated Feb. 27, 2014; U.S. Appl. No. 13/126,729; Response Filed May 27, 2014 (7 p.).

U.S. Notice of Allowance dated Jun. 16, 2014; U.S. Appl. No. 13/126,729 (5 p.).

PCT/NO2011/000289 International Search Report and Written Opinion dated Jan. 11, 2012 (8 p.).

Korean Office Action Dated Dec. 30, 2014; Korean Application No. 10-2013-7014143 (5 p.).

English Summary of Korean Office Action Dated Dec. 30, 2014; Korean Application No. 10-2013-7014143 (5 p.).

PCT/US2011/058969 International Search Report and Written Opinion dated Jan. 30, 2013 (13 p.).

* cited by examiner

DRILLING SYSTEM AND A DEVICE FOR ASSEMBLING AND DISASSEMBLING PIPE STANDS

CROSS-REFERENCE TO RELATED APPLICATIONS

This application is a 35 U.S.C. §371 national stage application of PCT/US2011/058969 filed Nov. 2, 2011, which claims the benefit of U.S. Provisional Application No. 61/409,459 filed Nov. 2, 2010, both of which are incorporated herein by reference in their entireties for all purposes.

STATEMENT REGARDING FEDERALLY SPONSORED RESEARCH OR DEVELOPMENT

Not applicable.

BACKGROUND

1. Field of the Invention

The disclosure relates generally to apparatus and methods for assembling and disassembling pipe joints for well drilling, production, maintenance, or combinations thereof. More particularly, the disclosure relates to a pipe joint rack unit configured to independently store at least two pipe joints below the drilling deck and to aid in the coupling of tubulars.

2. Background of the Technology

Oil and gas well systems employ numerous types of elongated tubulars including, for example, drill pipes, casings, and collars that are coupled together end-to-end. For ease of handling, groups of two or more individual tubulars are commonly joined together to form "stands." These stands may then be coupled to form a longer series of coupled tubulars called a "string." Various types of strings are known in the oil and gas industry based on the task performed, e.g., drill strings for drilling, completion string for completion operations, and production string for producing hydrocarbons. The operation of constructing stands and ultimately constructing a long "string" of joined tubulars and running the string into a borehole, or a well, is performed primarily on a drilling floor or drilling deck. The operation of retrieving a pipe string from the borehole, or well, and dismantling the pipe string into separate stands or pieces of pipes is likewise performed primarily on a drill floor.

Each individual pipe or tubular is threaded at both ends. To couple two or more pipes into a pipe stand, an end of one pipe is threaded, or screwed, into the end of the other pipe. Conversely, to decouple two pipes, one pipe is unthreaded from the other pipe until disengaged. In some instances, the coupling and decoupling operations are accomplished using motor-driven tools.

To increase the efficiency of the assembly or disassembly of stands and strings, some pipe coupling or decoupling procedures are performed in an area located outside of or remote to the central area of the drill floor, i.e. away from the center of the borehole, or well. For example, sets of individual pipes may be initially assembled into a pipe stand in the remote area outside the central area. The assembled pipe stand may then be moved into the central area for connection to a downhole string. Alternatively, a pipe string may be dismantled into two or more pipe stands in the central area. Each pipe stand is then moved into the remote area for further disassembly. In each scenario, the assembly or disassembly procedures are distributed between two or more areas of the drill floor.

Typically during assembly or disassembly of pipe stands, each piece of pipe is solitarily and temporarily disposed in a storage area provided by a substantially vertical tubular housing located in or below the drilling deck. The housing is open at its upper end and includes a pipe support at its lower end. The tubular housing is installed such that its open upper end is concentrically disposed about a mousehole in the drilling deck, which provides access to the housing. The pipe support may be an end or bottom plate. The depth of the storage area within the housing is determined by the positioning of the pipe support.

To assemble four pipes into a four-pipe stand, a first pipe is placed in the tubular housing, a second pipe is brought to a vertical position above the first pipe and then lowered to engage the first pipe. The two pipes are screwed together to form a first "two-pipe stand" by use of a tool located proximate the mousehole on the drilling deck. The first two-pipe stand is lifted from the vicinity of the mousehole and placed in an intermediate storage area. Next, a second "two-pipe stand" is constructed in the shallow tubular housing following the same steps. The second two-pipe stand is transferred through another mousehole in the drilling deck into a deeper tubular housing, so that the upper end of the second two-pipe stand can be positioned at a suitable working height above the drill floor. The first two-pipe stand is retrieved from the intermediate storage area and coupled to the top of the second two-pipe stand located in the deeper tubular housing to complete the four-pipe stand. The four-pipe stand is lifted and brought to the central area of the drill floor, or placed in the intermediate storage area. Disassembly of the four-pipe stand is accomplished using substantially the same steps but performed in the opposite order.

A drawback of the above-described assembly and disassembly operations is the need for tubular housings having different depths (to accommodate a single pipe vs. a two pipe stand) or need to adjust the depth of the storage area within the housing. Another potential drawback of these operations is the need to move pipe stands between housing of differing depths or between a tubular housing and an intermediate storage area. Such adjustments and movements increase the time required to complete the operation and thus reduce the assembly or disassembly operation efficiency. Furthermore, in designs wherein the tubular housing itself moves with respect to the surroundings, there is potential for the device to entangle nearby wires, flexible conduit, or other features under the drilling deck. Accordingly, there remains a need in the art for apparatus and methods that increase the efficiency of pipe assembly or disassembly operations.

BRIEF SUMMARY OF THE DISCLOSURE

These and other needs in the art are addressed in one embodiment by a system for storing one or more tubulars. The system comprises a drilling deck including a hole offset from a wellbore centerline. In addition, the system comprises a rack unit coupled to the drilling deck and extending downward from the hole in the drilling deck. The rack unit comprises a tubular housing having a longitudinal axis, an upper end, and a lower end opposite the upper end. The rack unit also comprises a first rack disposed within the body. The first rack is moveably coupled to the body.

These and other needs in the art are also addressed by a method for constructing a pipe stand. The method comprises a first step of positioning a rack unit below a hole in a drilling deck. The rack unit comprises a tubular housing having a longitudinal axis, a first rack disposed in the body, and an elevator disposed in the body. The method further comprises moving the first rack from a first position laterally offset from the elevator to a second position aligned with the elevator. The method also comprises moving the first rack from the first position to the second position. In addition, the method comprises moving the elevator axially upward through at least a portion of the first rack. Further, the method comprises inserting a first pipe joint through the hole into the first rack. Still further, the method further comprises supporting the first pipe joint in the first rack with the elevator, and lowering the first pipe joint into the first rack with the elevator.

These and other needs in the art are addressed in another embodiment by a system for storing one or more tubulars. In an embodiment, the system comprises a drilling deck including a hole offset from a wellbore centerline. In addition, the system comprises a rack unit coupled to the drilling deck and extending downward from the hole in the drilling deck. The rack unit comprises a housing having a longitudinal axis, an upper end, and a lower end opposite the upper end. The rack unit also comprises a first rack disposed within the housing and configured to receive a tubular. The first rack includes an upper guide pivotally coupled to the housing and a lower guide pivotally coupled to the housing. The upper guide and the lower guide of the first rack are configured to pivot about a first rotational axis. The rack unit further comprises an elevator disposed within the housing and configured to move axially up and down within the housing.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the disclosed embodiment(s) of the invention, reference will now be made to the accompanying drawings in which.

DETAILED DESCRIPTION OF THE DISCLOSED EMBODIMENTS

Figure 1:
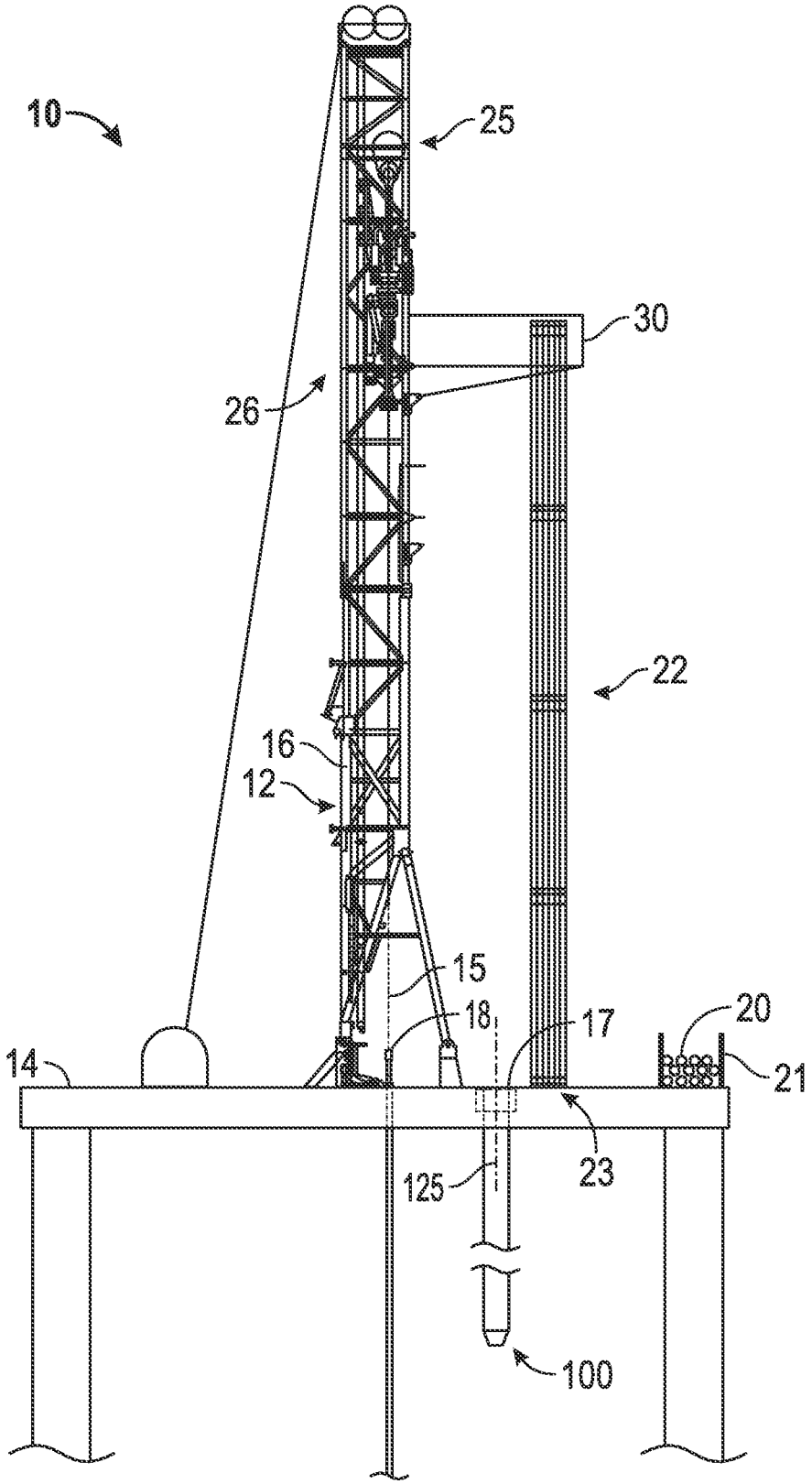
FIG. 1 is a schematic elevation view of an embodiment of a drilling system in accordance with the principles disclosed herein.

The following discussion is directed to various embodiments of the invention. The embodiments disclosed should not be interpreted or otherwise used as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in interest of clarity and conciseness. In addition, like or identical reference numerals may be used to identify common or similar elements.

In the following description and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples or is coupled to a second device, that connection may be through a direct connection, or through an indirect connection via other devices, components, and connections. If the connection transfers electrical power or signals, the coupling may be through wires or through wireless electromagnetic transmission, for example optical transmission, or through another means. In addition, as used herein, the terms "axial" and "axially" shall mean along or parallel to a given axis (e.g., central axis of a body or a port), while the terms "radial" and "radially" shall mean perpendicular to the axis. For instance, an axial distance refers to a distance measured along or parallel to the axis, and a radial distance means a distance measured perpendicular to the axis. Further, as used herein, the term "pipe," "pipe joint" and "pipe segment" shall mean a discrete joint or section of pipe (e.g., a drill pipe joint); and the term "pipe stand" shall mean the combination of two or more pipe joints connected together end-to-end.

Referring now to FIG. 1, an embodiment of an offshore drilling system 10 is shown. In this embodiment, drilling system 10 includes a rig structure 12 having a drilling deck 14 and a mast or derrick 16 coupled to deck 14. Vertically-extending derrick 16 supports a drill string 18 suspended within a drilling riser defining a drilling centerline 15. In particular, the upper portion of the derrick 16 includes a top drive system 25 and pipe elevator 26 that support drill string 18, which extends through the drilling deck 14, the drilling riser, and into a subsea borehole.

One or more storage areas are provided for individual pipe joints 20 and pipe stands 22. In this embodiment, a first storage unit 21 temporarily stores a plurality of pipe joints 20 in a horizontal orientation on deck 14, and a second storage unit 23 temporarily stores a plurality of pipe stands 22 in a vertical orientation. Pipe joints 20 in storage unit 21 are used to assembly pipe stands 22, which may then be added to drillstring 18. In this embodiment, each pipe stand 22 is made of four individual pipe joints 20 connected together end-to-end. Storage unit 23 includes a racking or finger board 30 extending horizontally from derrick 16 above drilling deck 14. As shown, storage units 22, 23 are offset or radially spaced away from centerline 15.

Referring still to FIG. 1, an embodiment of a rack unit 100 is radially offset from centerline 15, and extends vertically downward from drilling deck 14. A hole 17 in drilling deck 14, also referred to as a mousehole, provides access to rack unit 100 and allows pipe joints 20 to be lower into and pulled from rack unit 100. As will be described in more detail below, rack unit 100 is used to temporarily store a plurality of pipe joints 20 for assembly and disassembly of pipe stands 22.

In general, any suitable pipe handling device or system may be used to engage a individual pipe joints 20, as well as individual pipe stands 22, to manipulate and move joints 20 and stands 22 between storage units 21, 23, rack unit 100, and centerline 15. The pipe handling system may be robotic, meaning automated or remotely operated. During some operations, one or more workers located on or near racking board 30 may manually control the movement of pipe joints 20 or pipe stands 22. Examples of suitable pipe handling systems are disclosed in U.S. Pat. Nos. 7,841,415, 7,228,919, 6,976,540, 7,736,119, 7,083,007, and U.S. Patent Application Publication Nos. 2007/0251728 and 2008/0164064, each of which is hereby incorporated herein by reference in its entirety for all purposes.

Drilling deck 14 may support other types of equipment (not shown) for drilling or tripping operations including, without limitation, stabbing systems, slips, pipe lubricators, mud pumping systems, and other systems used in making up or breaking out pipe joints. For example, one or more clamping devices or tongs may be supported by deck 14 and used to grasp pipe joints 20 and pipe stands 22 to hold them against rotation. Such clamping devices may be manual, automated, or semi-automated.

Figure 2:
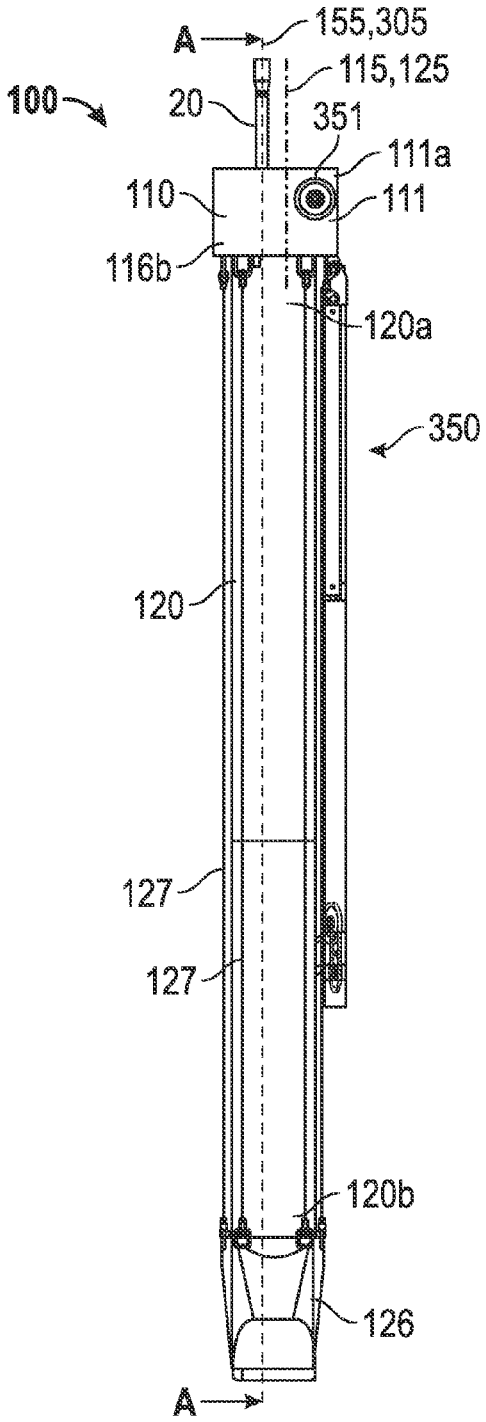
FIG. 2 is an elevation side view of the rack unit of FIG. 1.
Figure 3:
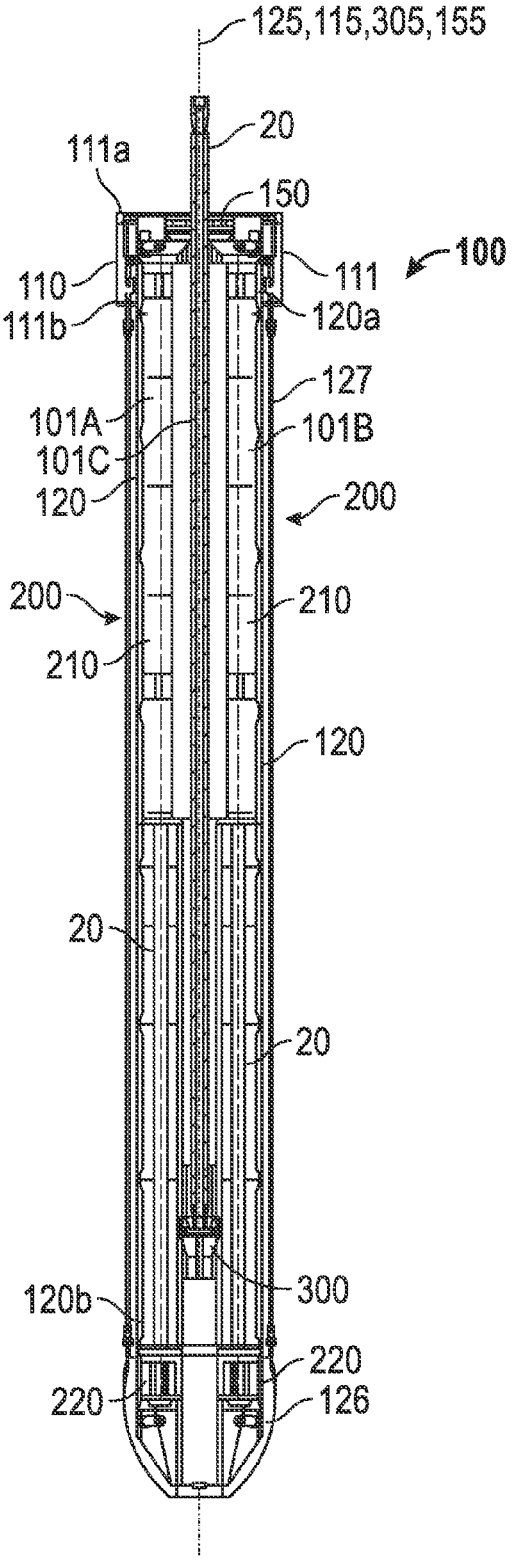
FIG. 3 is a cross-sectional elevation view of the rack unit in FIG. 2 taken along section A-A of FIG. 2.
Figure 4:
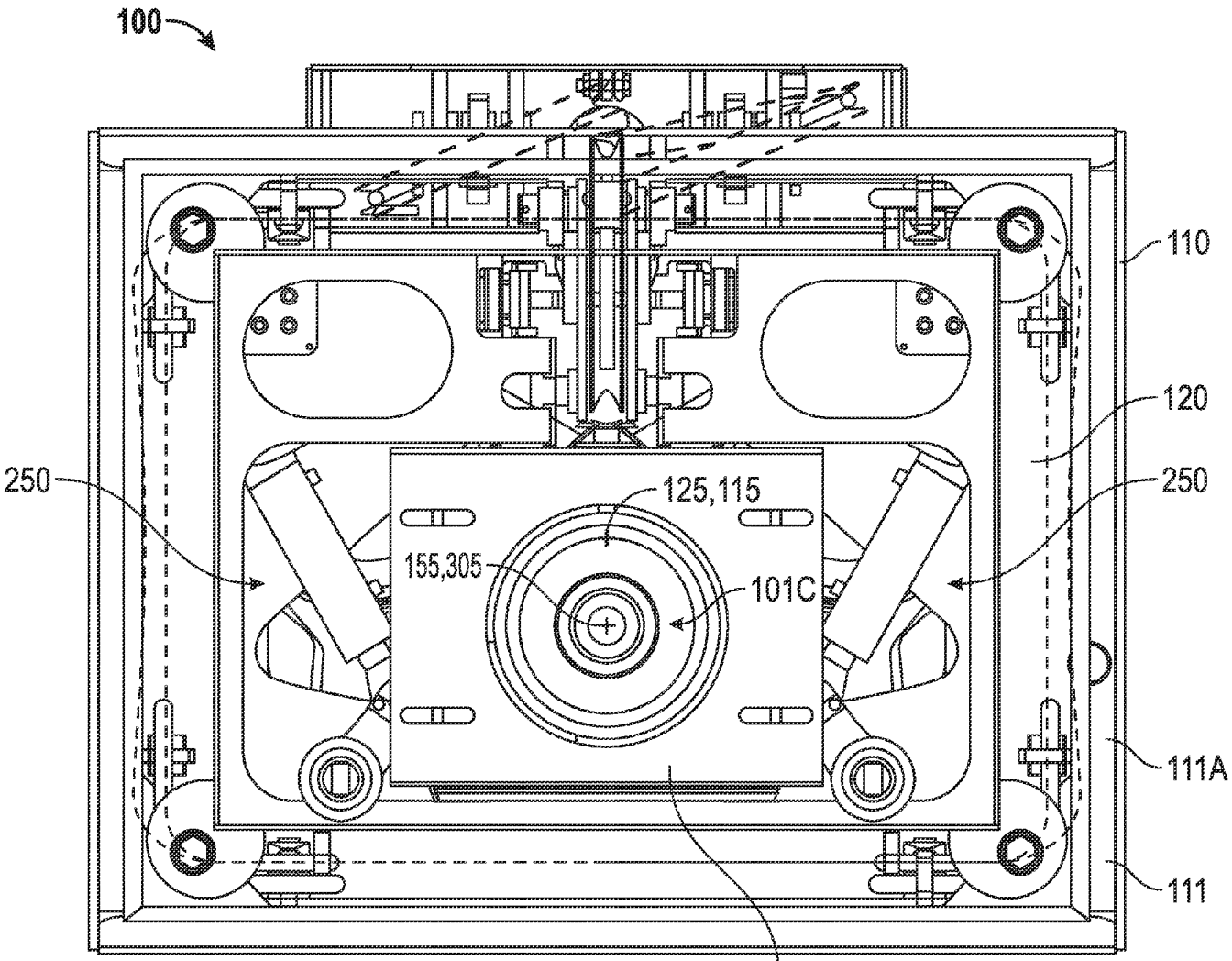
FIG. 4 is an enlarged top view of the rack unit of FIG. 2.

Referring now to FIGS. 2-4, in this embodiment, rack unit 100 includes a foundation or mounting assembly 110 secured to the underside of drill deck 14, a main body or housing 120 hung from assembly 110, a pair of racks 200 pivotally disposed in housing 120, and an elevator 300 moveably disposed in housing 120. Each rack 200 operates to receive and temporarily store one pipe joint 20 that is used in the assembly of a pipe stand 22. In other words, each rack 200 defines a pipe storage location within housing 120. Consequently, racks 200 may also be referred to herein as pipe joint storage assemblies. A third pipe joint 20 having its lower end supported by elevator 300 may be stored in rack unit 100 between racks 200. In other words, the space within housing 120 between racks 200 may function as an additional pipe storage location within housing 120. Thus, in this embodiment, rack unit 100 can temporarily store up to three individual pipe joints at any given time—one pipe joint 20 can be stored in each rack 200, and one pipe joint 20 can be stored between racks 200. The three pipe storage locations, designated by reference numerals 101A, 101B, 101C, will be described in more detail below.

Figure 5:
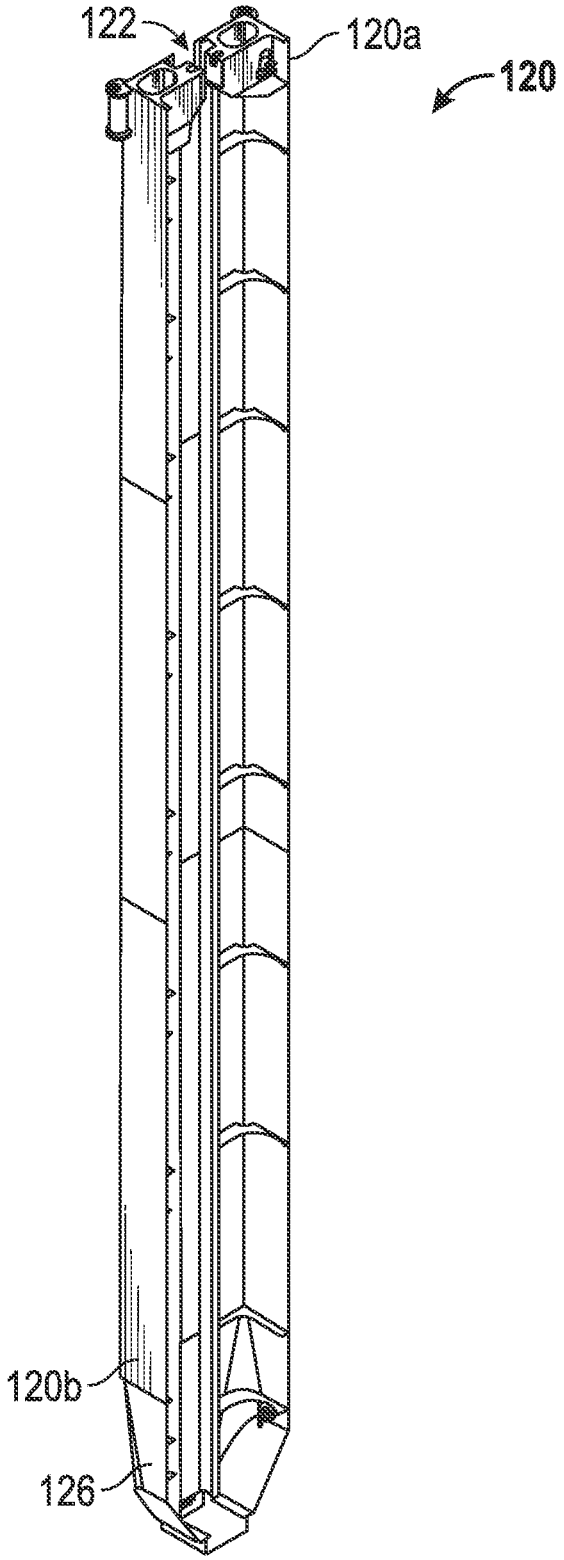
FIG. 5 is a perspective sectional view of the main body of the rack unit shown of FIG. 2.

Referring now to FIGS. 2, 3, and 5, housing 120 is an elongate tubular structure having a central or longitudinal axis 125, a first or upper end 120*a*, and a second or lower end 120*b* opposite end 120*a*. Upper end 120*a* is attached to mounting assembly 110, thereby coupling housing 120 to deck 14, and lower end 120*b* is distal deck 14. Upper end 12*a* is open, however, a capture basket 126 is coupled to housing 120 at lower end 120*b*, thereby closing off lower end 120*b* and preventing pipe joints 20 from falling completely therethrough. In this embodiment, capture basket 126 is held in position by a plurality of circumferentially spaced cables 127 that extend vertically from mounting assembly 110 to capture basket 126. As best shown in FIGS. 3 and 4, a centralizer 150 is positioned within mounting assembly 110 axially adjacent upper end 120*a* and serves as the entry and exit location for pipe joints 20 loaded into and unloaded from housing 120. In general, centralizer 150 facilitates the vertical orientation of each pipe joint 20 (i.e., parallel to axis 125) being loaded into and unloaded from housing 120.

Referring again to FIGS. 2-4, mounting assembly 110 couples the rack unit 100 to drilling deck 14. In this embodiment, mounting assembly 110 comprises a generally rectangular body or housing 111 having a central or longitudinal axis 115 coaxially aligned with axis 125, an open upper end 111*a*, and an open lower end 111*b*. Upper end 120*a* of housing 120 is coaxially received by housing 111 and secured therein with a plurality of bolts. Although a distinct and separate mounting assembly 110 is employed to couple housing 120 to deck 14 in this embodiment, in other embodiments, the mounting assembly (e.g., mounting assembly 110) may be integral with the upper end of the main body (e.g., housing 120), or the main body may be directly secured to the drilling deck.

As best shown in FIG. 2, an elevator drive 350 extends from lower end 111*b* of housing 111 along the outside of housing 120. Elevator drive 350 moves elevator 300 axially up and down within housing 120 between a first or upper position proximal upper end 120*a* and a second or lower position proximal lower end 120*b*. As will be described in more detail below, elevator 300 is transitioned between the upper and lower positions with drive 350 during the loading and unloading of individual pipe joints 20. Although elevator 300 is described as having upper and lower positions within housing 120, it should be appreciated that elevator 300 may be stopped at any desired axial position within housing 120.

Figure 6:
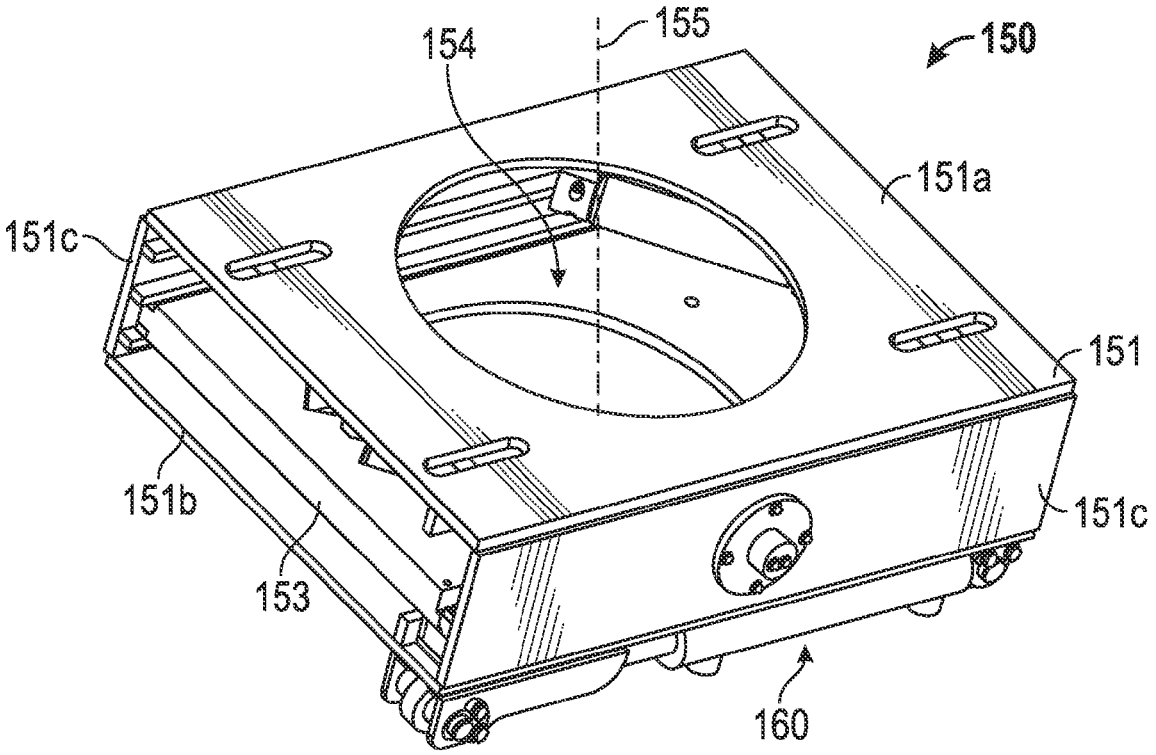
FIG. 6 is a perspective view of the centralizer of the rack unit of FIG. 2.
Figure 7:
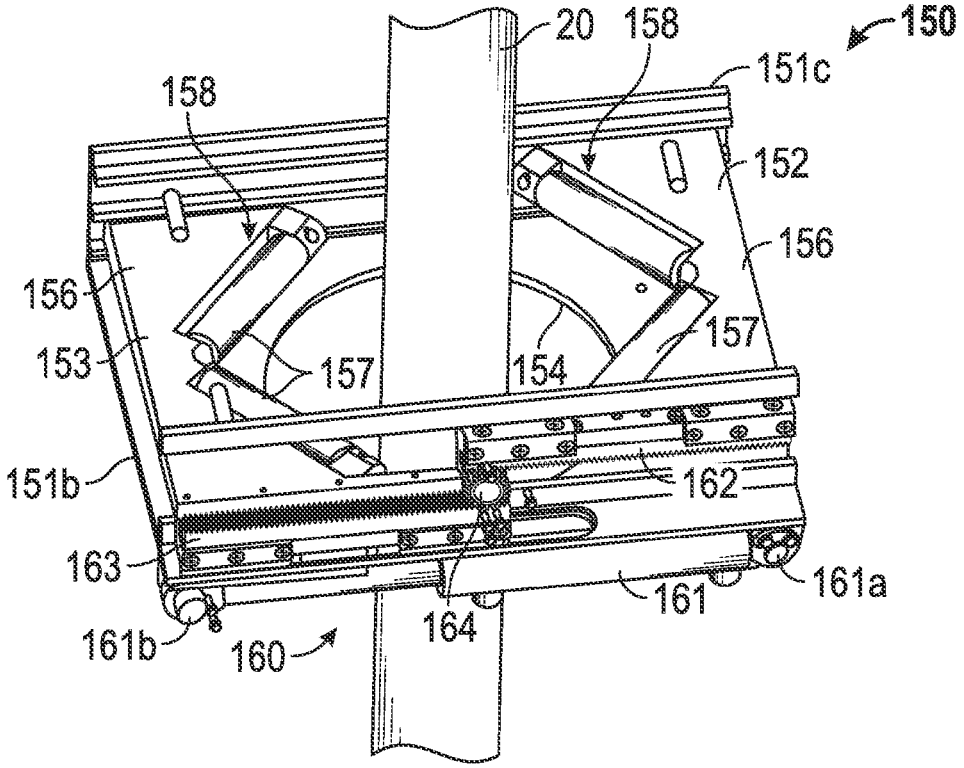
FIG. 7 is a partial perspective view of the centralizer of FIG. 6 with a portion of the housing removed to illustrate several internal features.

Referring now to FIGS. 4, 6, and 7, centralizer 150 functions to keep the individual pipe joint or tubular 20 supported by elevator 300 in a vertical or substantially vertical orientation axially within rack unit 100. In this embodiment, centralizer 150 includes an outer housing 151, a pair of opposed jaw clamps 152, 153 moveably disposed within housing 151, and a drive assembly 160 that actuates jaw clamps 152, 153. Housing 151 includes a horizontal upper plate 151*a*, a horizontal lower plate 151*b*, and a pair of lateral or side plates 151*c* extending vertically between plates 151*a*, 151*b*. A through bore or passage 154 having a vertical central axis 155 that extends though housing 151 and is parallel to axis 125 of housing 120. When a pipe joint 20 is lowered into rack unit 100 or pulled from rack unit 100, it passes vertically through passage 154 of centralizer 150.

Jaw clamps 152, 153 are disposed within housing 151 on opposite sides of axis 155 and are moved radially inward and outward relative to axis 155 with drive assembly 160. In particular, jaw clamps 152, 153 are moved radially inward to grasp a pipe joint 20 extending through passage 154 and move it into a vertical orientation aligned with axis 155. In this embodiment, each jaw clamp 152, 153 includes a base 156 and a pair of roller elements 157 rotatably coupled to base 156. Outer edges of each base 156 are slidably disposed in mating guides or recesses formed on the inner surfaces of side plates 151*c* of housing 151. As best shown in FIG. 7, base 156 is a plate having a radially inner V-shaped notch 158. Roller elements 157 are disposed within notch 158, with each roller element 157 extending along one edge of base 156 defining notch 158. In this embodiment, roller elements 157 of each jaw clamp 152, 153 are angularly spaced 90° degrees. To ensure jaw clamps 152, 153 do not interfere with each other as they move radially inward, jaw clamp 152 is positioned immediately axially above jaw clamp 153. Thus, as jaw clamps 152, 153 move radially inward, the leading edges of jaw clamp 153 pass below the leading edges of jaw clamp 152.

Referring still to FIG. 7, drive assembly 160 simultaneously moves both jaw clamps 152, 153 radially inward and radially outward relative to axis 155 and any pipe joint 20 extending through passage 154. In this embodiment, drive assembly 160 includes an actuator 161 extending between housing 151 and base 156, a pair of gear racks 162, 163 mounted to opposed surfaces of bases 156, and a pinion gear 164 disposed between racks 162, 163. In particular, one gear rack 162 is mounted on the underside of base 156 of first clamp jaw 152, and the other gear rack 163 is mounted along the upper side second clamp jaw 153. Pinion gear 164 meshes with both racks 162, 163. Thus, as pinion gear 164 rotates in a first direction, racks 162, 163, and hence jaw clamps 152, 153, move radially inward toward each other, and when gear 164 rotates in a second direction opposite the first direction, racks 162, 163, and hence jaw clamps 152, 153, move radially outward away from each other. Thus, the movement of each jaw clamp 152, 153 is tied to the movement of the other jaw clamp 152, 153.

Actuator 161 has a first end 161*a* attached to plate 151*b* of housing 151 and a second end 161*b* coupled to jaw clamp 153. In FIG. 7, actuator 161 is shown below housing 151; however, lower plate 151*b* includes a linear slot that slidingly receives a connection member extending between second end 161*b* and base 156 of lower jaw clamp 153. In this embodiment, actuator 161 is a bi-directional linear actuator, such as a hydraulic cylinder, configured to linearly extend and refract, thereby moving jaw clamp 153 radially inward and outward relative to axis 155 and any pipe joint 20 extending through passage 154. The radial movement of jaw clamp 153 is translated to jaw clamp 152 via racks 162, 163 and pinion gear 164 as previously described. Thus, when actuator 161 extends, jaw clamps 152, 153 move radially outward away from axis 155 and any pipe joint 20 therein, and when actuator 161 contracts, jaw clamps 152, 153 move radially inward toward axis 155 and any pipe joint 20 therein. Jaw clamps 152, 153 and drive assembly 160 are configured such that jaw clamps 152, 153 are uniformly radially spaced relative to axis 155. Consequently, when jaw clamps 152, 153 move radially inward and engage pipe joint 20, they urge pipe joint 20 to a vertical orientation coaxially aligned with axis 155.

Figure 8:
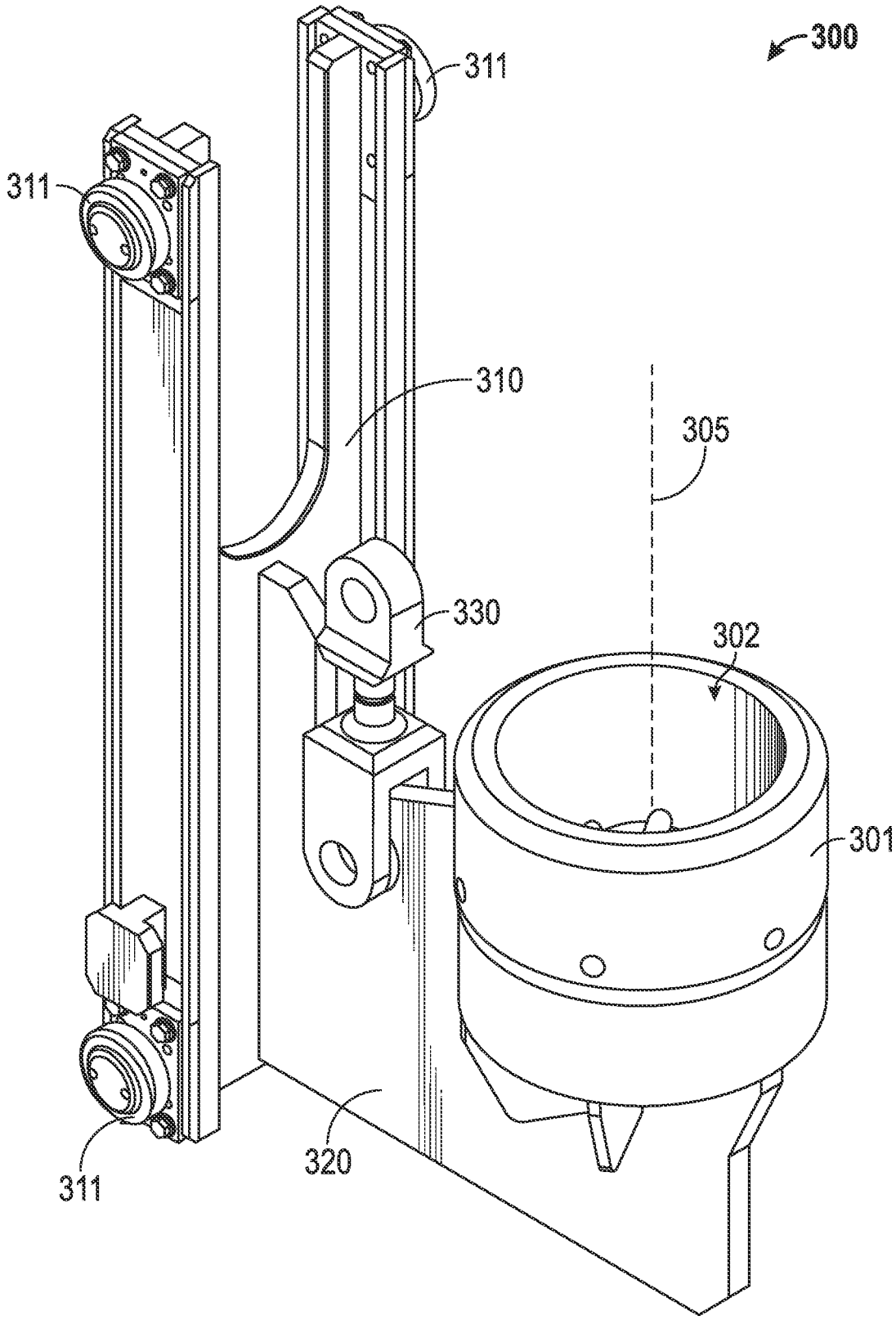
FIG. 8 is a perspective view of the elevator of the rack unit of FIG. 2.

Referring now to FIGS. 3 and 8, elevator 300 is configured to move a pipe joint 20 extending through passage 154 and centralizer 150 axially up and down within housing 120. As best shown in FIG. 8, in this embodiment, elevator 300 includes a cylindrical, cup-shaped support member 301, a trolley 310 coupled to support member 301 with an extension arm 320, and a lifting member 330 pivotally coupled to arm 320 between member 301 and trolley 310. Pipe support member 301 is cylindrical and has a vertical central axis 305 coaxially aligned with axis 155 and an upward-facing receptacle or opening 302 sized and configured to receive the lower end of one pipe joint 20. Extension arm 320 has one end attached to support member 301 and the opposite end attached to trolley 310. In this embodiment, extension arm 320 is a vertically oriented plate having a relatively narrow horizontal width. Trolley 310 is secured to extension arm 320 and is moveably disposed within a mating vertical channel 122 in housing 120 as shown in FIG. 5. In this embodiment, trolley 310 includes a plurality of wheels 311 that allow trolley 310 to move smoothly up and down through channel 122. Referring now to FIGS. 2, 3, and 8, a cable (not shown) extends from elevator drive 350 over a pulley 351 at upper end 120*a* of housing 120 to lifting member 330, thereby enabling elevator drive 350 to pull elevator 300 axially up and down within housing 120.

Referring again to FIG. 3, as previously described, rack unit 100 includes two racks 200. Each rack 200 is disposed in housing 120, pivotally coupled to housing 120, and configured to receive one pipe joint 20, temporarily store the pipe joint 20, and then supply the stored pipe joint 20 during assembly of a pipe stand 22. In particular, each rack 200 is independently rotated between a pipe joint loading/unloading position coaxially aligned with axes 155, 305, and a pipe joint storage position laterally offset and radially spaced apart from axes 155, 305 and elevator 300. In the loading/unloading position, rack 200 is positioned to receive a pipe joint 20 lowered through passage 154 in centralizer 150 (if a pipe joint 20 is not already disposed in rack 200) or supply a pipe joint 20 through passage 154 (if a pipe joint 20 is already disposed in rack 200); and in the storage position, rack 200 is positioned so as to not interfere with elevator 300 as it moves axially up and down during the loading or unloading of a pipe joint into a different storage location (e.g., into the other rack 200). For example, in FIG. 12, each rack 200 is in its storage position; in FIG. 13, one rack 200 (the rack 200 on the left) is in its loading/unloading position and the other rack 200 (the rack 200 on the right) is in its storage position; and in FIG. 15, one rack 200 (the rack 200 on the right) is in its loading/unloading position and the other rack 200 (the rack 200 on the left) is in its storage position. It should be appreciated that only one rack 200 can be disposed at the loading/unloading position at a particular time.

Referring again to FIG. 3, in this embodiment, each rack 200 includes an upper guide 210 rotatably coupled to housing 120 and a lower guide 220 rotatably coupled to housing 120. Each rack 200 is moved between the loading/unloading position and the storage position by the simultaneous, synchronized movement of the corresponding guides 210, 220 with a pair of drive units 250. For a given rack 200, one drive unit 250 actuates the upper guide 210 and a different drive unit 250 actuates the associated lower guide 220.

Figure 9:
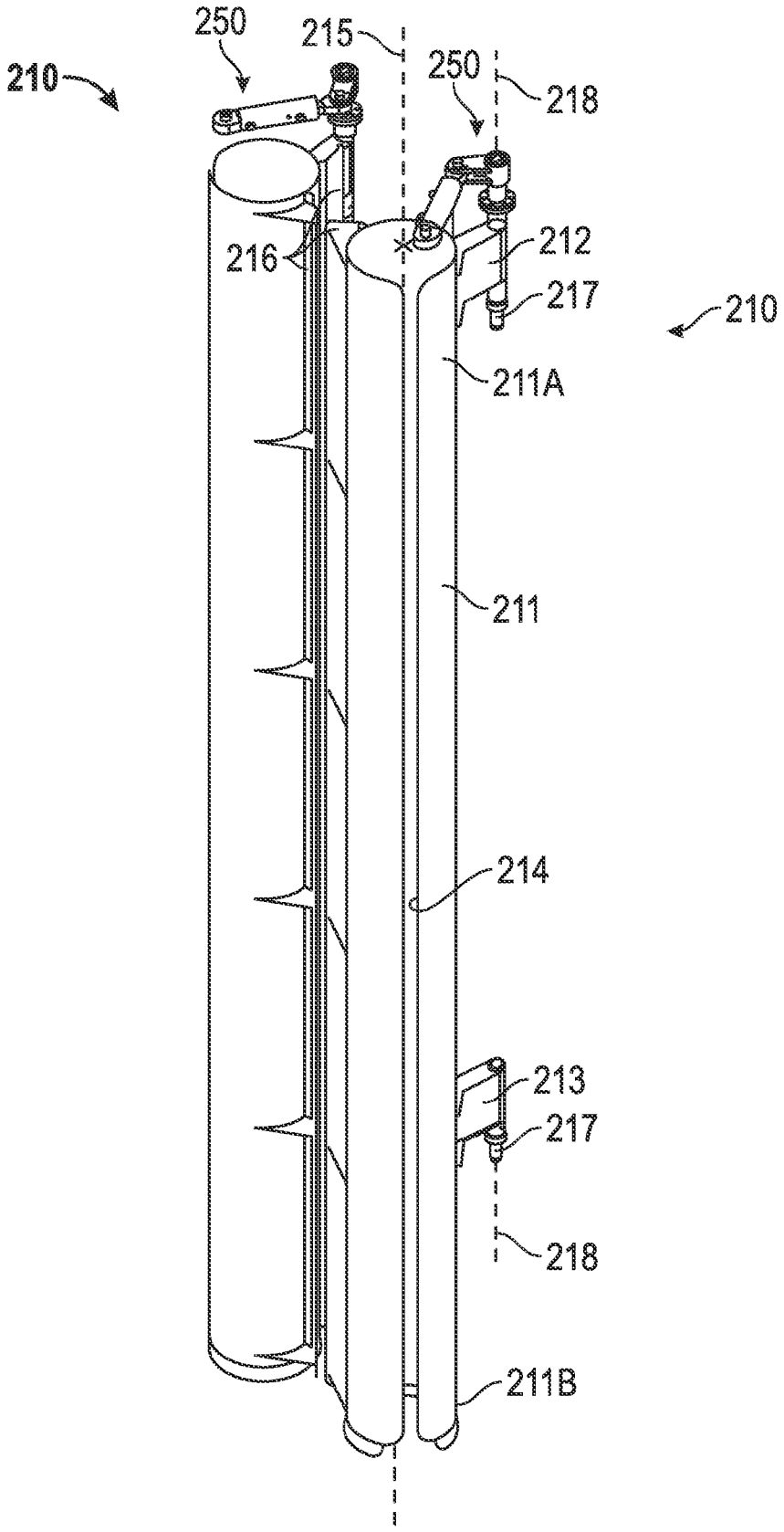
FIG. 9 is a rear perspective view of upper guides and associated drive units of the racks of FIG. 3.

Referring now to FIG. 9, upper guides 210 of racks 200 are mirror images of each other across a vertical plane containing axes 155, 125, and thus, only one upper guide 210 will be described, it being understood that the other upper guide 210 is the same. Upper guide 210 includes a tubular body 211 having a central or longitudinal axis 215, a first or upper end 211*a*, and a second or lower end 211*b* opposite end 211*a*. An upper mounting arm 212 extends radially outward from body 211 at upper end 211*a*, and a lower mounting arm 213 extends radially outward from body 211 between ends 211*a*, 211*b*. As will be described in more detail below, mounting arms 212, 213 rotatably couple upper guide 210 to housing 120.

Tubular body 211 includes an elongate slot 214 extending axially between ends 211*a*, 211*b*. Slot 214 has a circumferential width that is greater than the lateral width of extension arm 320 of elevator 300, and body 211 has an inner diameter that is greater than the outer diameter of pipe support member 301. Thus, slot 214 is sized to allow extension arm 320 to pass axially therethrough and body 211 is sized to allow pipe support member 301 to pass axially therethrough. As will be described in more detail below, during loading a pipe joint 20 into rack 200 and unloading a pipe joint 20 from rack 200, pipe support member 301 moves axially through body 211, with slot 214 accommodating extension arm 320.

Referring still to FIG. 9, a pair of generally rectangular elongate centralizing plates 216 extend radially outward from body 211 generally opposite slot 214. Each plate 216 extends axially between ends 211*a*, 211*b*. In this embodiment, one plate 216 is angularly spaced about 120° from slot 214 and the other plate 216 is angularly spaced about −120° from slot 214. As will be described in more detail below, when each rack 200 is in the storage position, plates 216 function as guides to ensure a pipe joint 20 supported by pipe support member 301 within housing 120 between racks 200 remains substantially vertical and does not fall over within housing 120.

Mounting arms 212, 213 are circumferentially positioned between plates 216 and slot 214. In this embodiment, each arm 212, 213 includes a vertical mounting pin or shaft 217 extending downward from the end of arm 212, 213 that is distal body 211. Pins 217 of arms 212, 213 share a common central axis 218. In this embodiment, each pin 217 is rotatably disposed in a mating receptacle on the inside of housing 120, thereby enabling upper guide 210 to rotate about axis 218 within housing 120.

Figure 10:
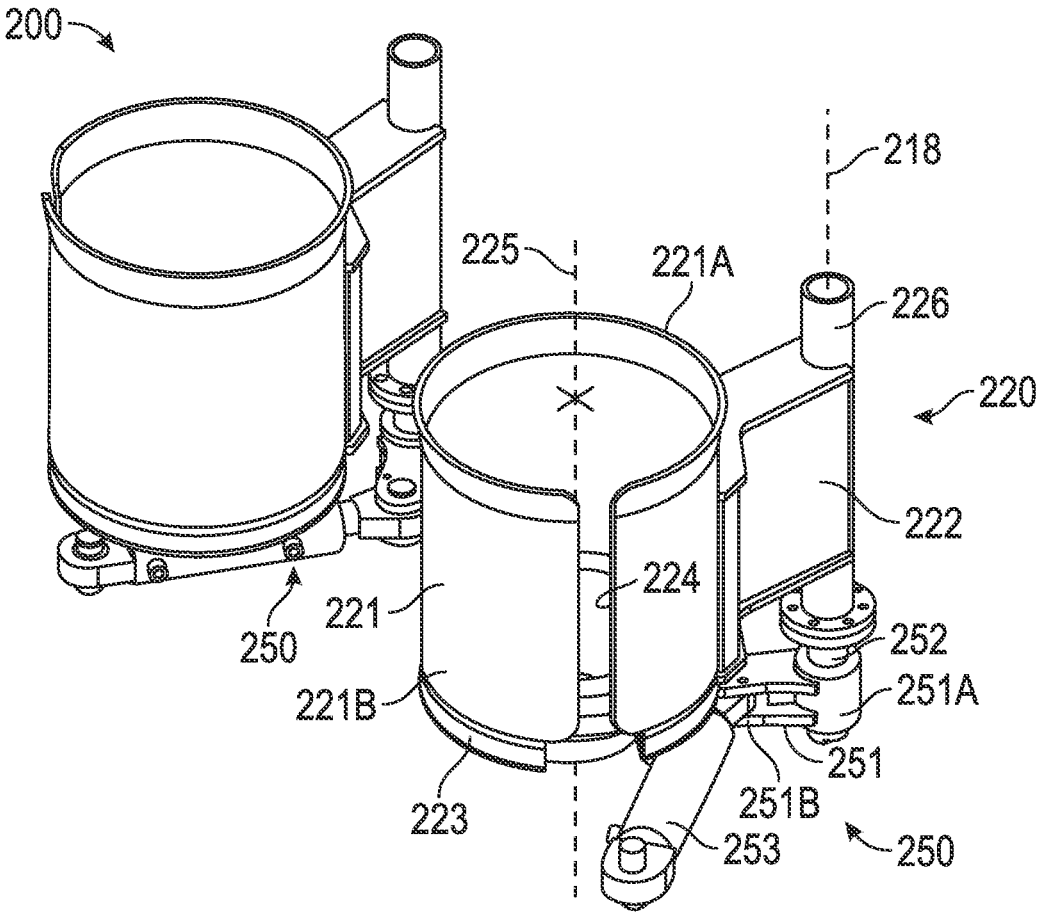
FIG. 10 is a rear perspective view of lower guides and associated drive units of the racks of FIG. 3.

Referring now to FIG. 10, lower guides 220 of racks 200 are mirror images of each other across a vertical plane containing axes 155, 125, and thus, only one lower guide 220 will be described, it being understood that the other lower guide 220 is the same. Lower guide 220 includes a tubular body 221 having a central or longitudinal axis 225, a first or upper end 221*a*, and a second or lower end 221*b* opposite end 221*a*. A mounting arm 222 extends radially outward from body 221 between ends 221*a*, 221*b*. As will be described in more detail below, mounting arm 222 rotatably couples lower guide 220 to housing 120.

Tubular body 221 includes an annular flange 223 extending radially inward at lower end 221*b*. Thus, flange 223 defines an annular shoulder on the inside of body 221 at lower end 22*b*. In addition, body 221 includes an elongate slot 224 extending axially between ends 221*a*, 221*b*. Slot 224 has a circumferential width that is greater than the lateral width of extension arm 320 of elevator 300, and the minimum inner diameter body 221 defined by flange 223 is greater than the outer diameter of pipe support member 301. Thus, slot 224 is sized to allow extension arm 320 to pass axially therethrough and body 221 is sized to allow pipe support member 301 to pass axially therethrough. As will be described in more detail below, during loading a pipe joint 20 into rack 200 and unloading a pipe joint 20 from rack 200, pipe support member 301 moves axially through body 221, with slot 224 accommodating extension arm 320.

Mounting arm 222 is circumferentially spaced from slot 224. In this embodiment, arm 222 includes a vertical mounting shaft 226 disposed at the end of arm 222 that is distal body 221. Shaft 226 is coaxially aligned with pins 217 of the corresponding upper guide 210 and is rotatably coupled to the inside of housing 120, thereby enabling lower guide 220 to rotate about axis 218 within housing 120.

Referring now to FIGS. 9 and 10, one drive unit 250 actuates each guide 210, 220. Only one drive unit 250 will be described, it being understood that each drive unit 250 is the same. Best seen in FIG. 10, in this embodiment, drive unit 250 includes an arm 251, a drive shaft 252, and a linear actuator 253. Shaft 252 is coaxially aligned with and coupled to a corresponding shaft 217, 226 of one guide 210, 220, respectively. In particular, shaft 252 is fixably connected to the corresponding shaft 217, 226 such that shaft 252 does not move rotationally or translationally relative to the shaft 217, 226. Arm 251 has a first end 251*a* fixably secured to shaft 252 and a second end 251*b* that is radially spaced from the corresponding shaft 217, 226 and pivotally coupled to one end of actuator 253. The opposite end of actuator 253 is pivotally coupled to the inside of housing 120. Once installed, arm 251 and actuator 253 are constrained to operate in a plane perpendicular to axis 218. Thus, when actuator 253 extends, arm 251 is pivoted or rotated about its first end 251*a* in a first direction, thereby simultaneously causing shaft 252, the corresponding shaft 217, 226, and the corresponding guide 210, 220 to rotate about axis 218 in the first direction; and when actuator contracts, arm 251 is pivoted or rotated about its first end 251*a* in a second direction opposite the first direction, thereby simultaneously causing shaft 252, the corresponding shaft 217, 226, and the corresponding guide 210, 220 to rotate about the axis 218 in the second direction. In this manner, the two drive units 250 of each rack 200 (one drive unit 250 for actuating upper guide 210 of each rack 200 and the second drive unit 250 for actuating lower guide 220 of each rack 200) function to transition the corresponding rack 200 between the loading/unloading position and the storage position. In general, actuator 253 may be any suitable type of linear actuator; however, in this embodiment, actuator 253 is a hydraulic piston-cylinder assembly.

Figure 11:
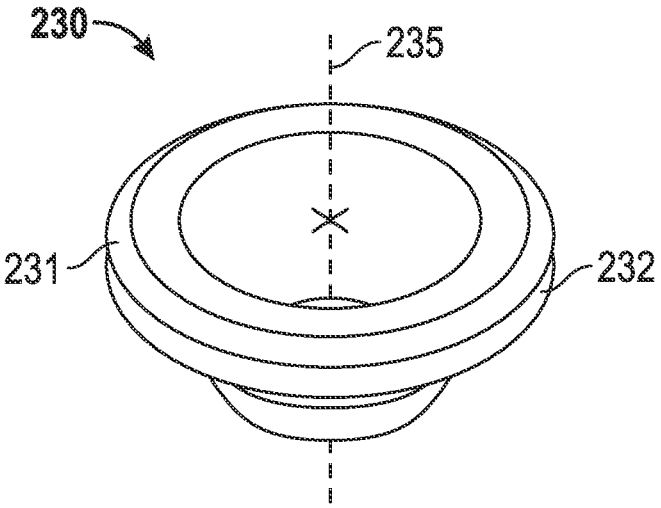
FIG. 11 is a perspective view of the cradle of one of the racks of FIG. 3.

Referring now to FIGS. 10 and 11, a cradle 230 is seated on the shoulder formed within body 221 of each lower guide 220. Each cradle 230 functions to support a pipe joint 20 as it is lowered into, stored in, and removed from the corresponding rack 200. Only one cradle 230 will be described it being understood that each cradle 230 is the same.

In this embodiment, cradle 230 comprises a central axis 235, a cup-shaped annular body 231, and an annular flange 223 extending radially outward from body 231. Body 231 is generally frustoconical, having an open upper end sized to receive the lower end of a pipe joint 20 and a closed lower end. Cradle 230 is generally coaxially aligned with corresponding tubular bodies 211, 221 and sized to move axially therethrough. However, engagement of annular flange 223 and the shoulder in body 221 of lower guide 220 prevents cradle 230 from falling completely through body 221. In other words, the outer diameter of cradle 230 is less than the inner diameter of bodies 211, 221, but is greater than the inner diameter of flange 223. Therefore, flange 223 is capable of holding cradle 230 within the lower end 221*b* of body 221. As pipe support member 301 of elevator 300 moves axially through bodies 211, 221 during pipe joint loading and unloading operations, it carries cradle 230.

Figure 12:
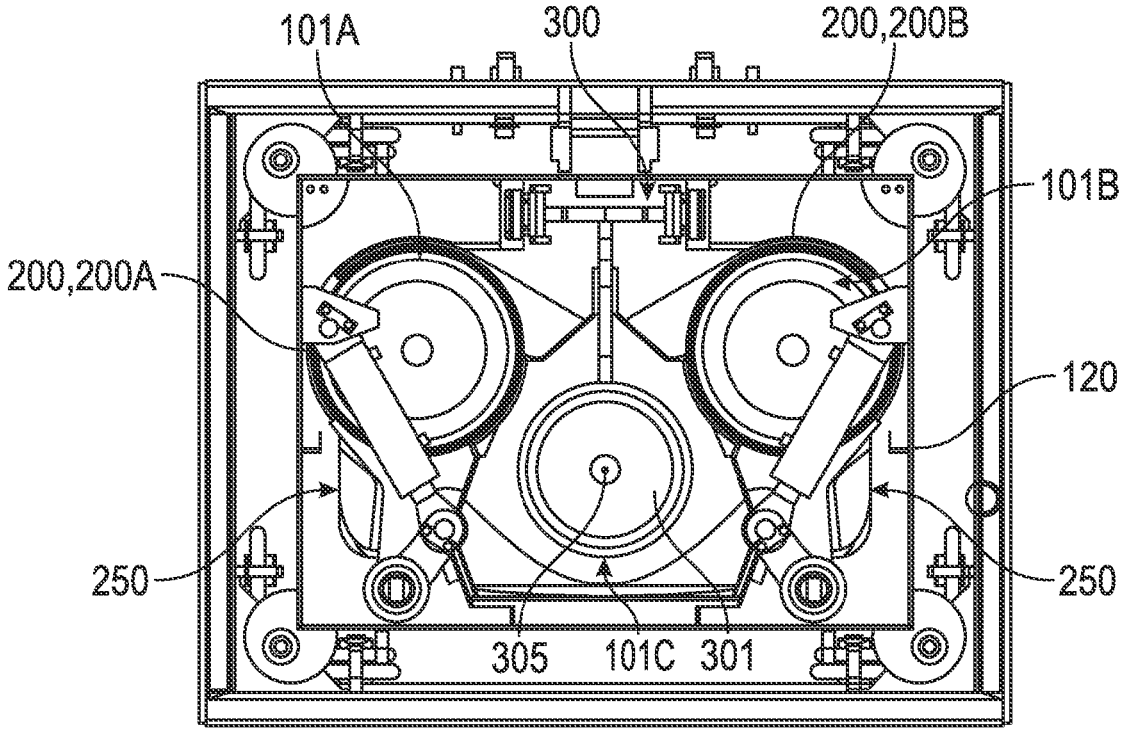
FIGS. 12-17 are sequential top views of the rack unit of FIG. 1 illustrating an exemplary method for loading the rack unit with three pipe joints.
Figure 13:
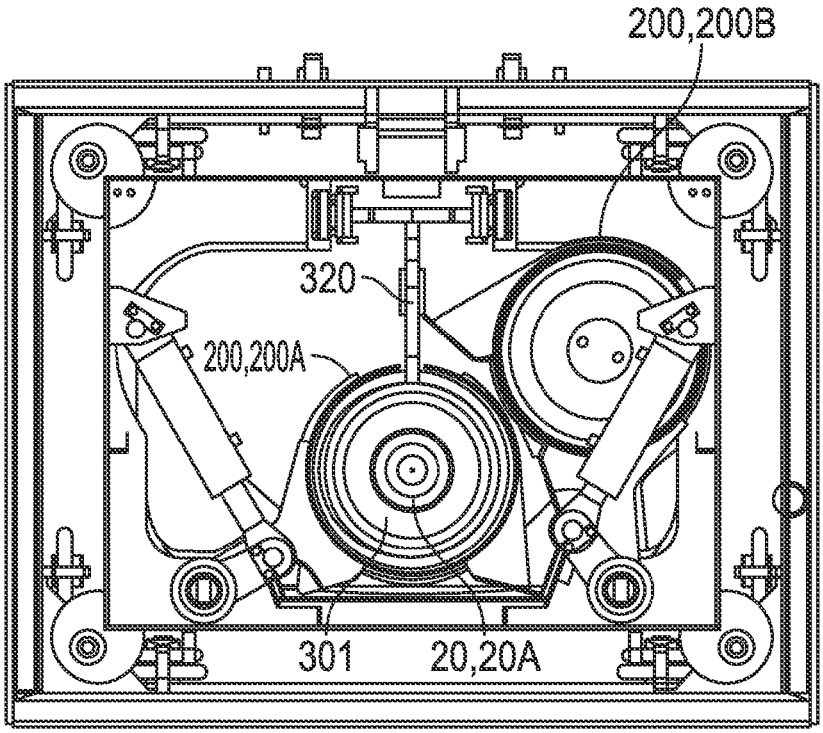
Figure 14:
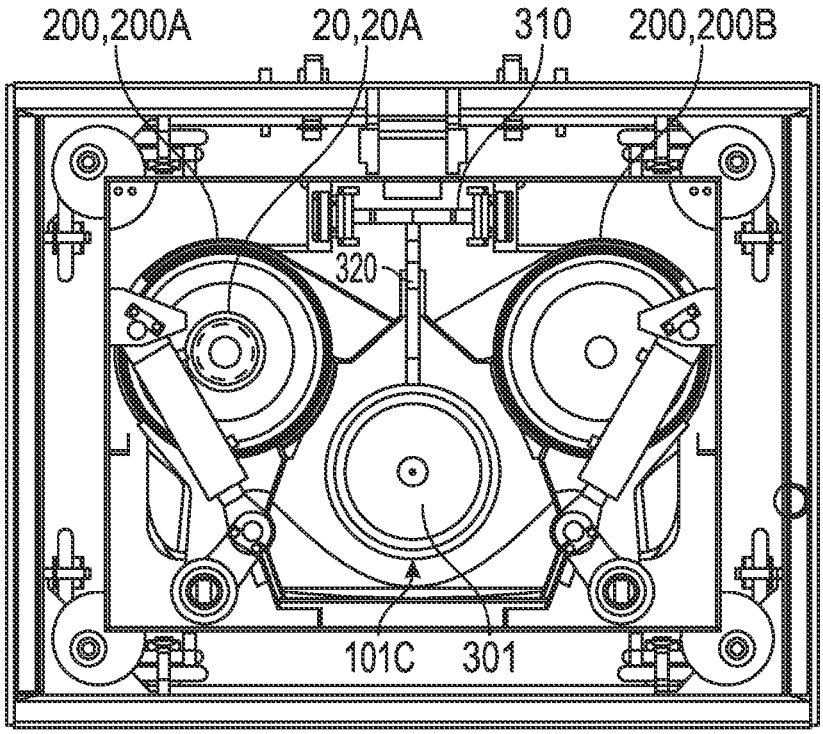
Figure 15:
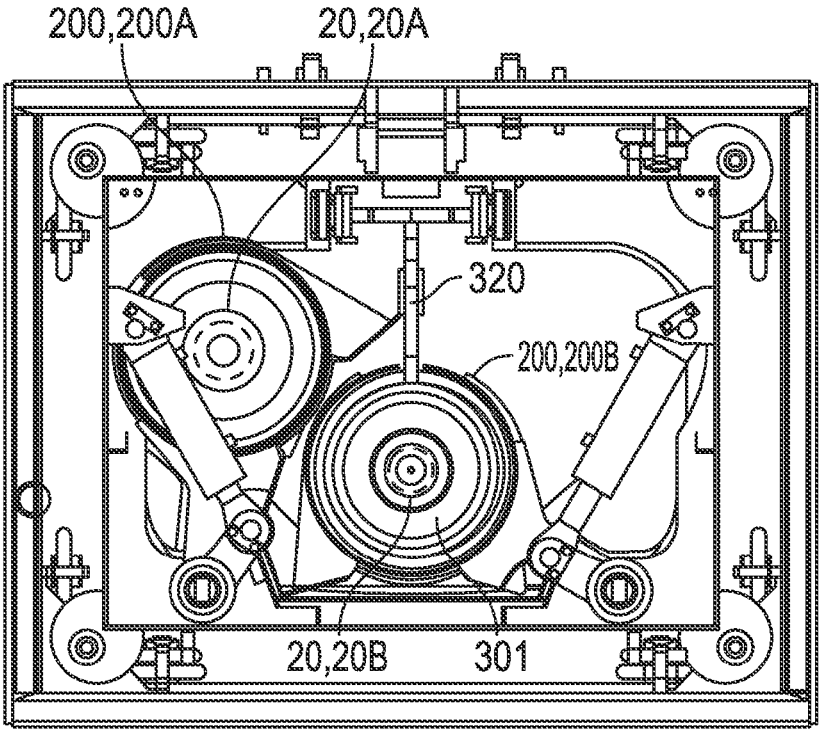
Figure 16:
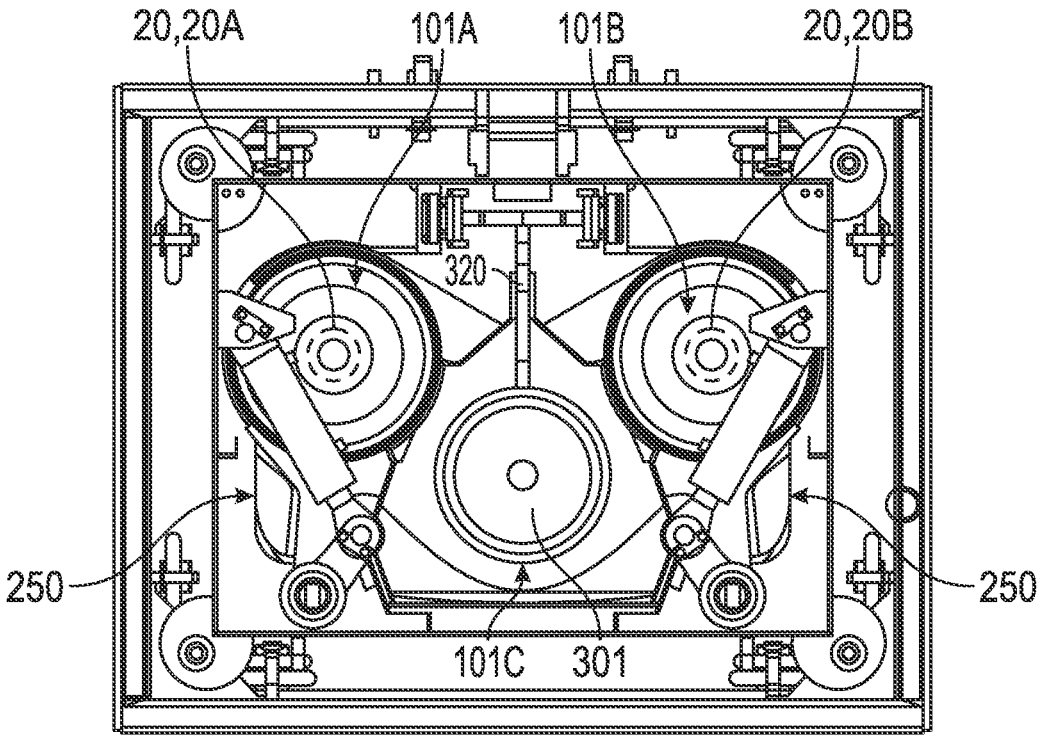

Referring now to FIGS. 12-17, the operation of rack unit 100 will now be described. For purposes of clarity, centralizer 150 is not shown in FIGS. 12-17, and for purposes of explanation, the rack 200 on the left of rack unit 100 in FIGS. 12-17 will be referred to as rack 200A and the rack 200 on the right of rack unit 100 in FIGS. 12-17 will be referred to as rack 200B. In FIG. 12, rack 200A is in its storage position laterally offset and radially spaced apart from axes 155, 305 and elevator 300, and rack 200B is also in its storage position laterally offset and radially spaced apart from axes 155, 305 and elevator 300; in FIG. 13, rack 200A is in its loading/unloading position coaxially aligned with axes 155, 305, and elevator 300, and rack 200B is in its storage position; in FIG. 14, both racks 200A, 200B are in their respective storage positions; in FIG. 15, rack 200A is in its storage position and rack 200B is in its loading/unloading position coaxially aligned with axes 155, 305, and elevator 300; and in FIGS. 16 and 17, both racks 200A, 200B are in their storage positions. Thus, FIGS. 12 and 13 illustrate the transition of rack 200A from its storage position to its loading/unloading position; FIGS. 13 and 14 illustrate the transition of rack 200A from its loading/unloading position to its storage position; FIGS. 14 and 15 illustrate the transition of rack 200B from its storage position to its loading/unloading position; and FIGS. 15 and 16 illustrate the transition of rack 200B from its loading/unloading position to its storage position. Elevator 300 is preferably positioned in the lower end of housing 120 below racks 200A, 200B when either rack 200A, 200B is transitioned between the storage position and the loading/unloading position to avoid interference therebetween. It should be appreciated that housing 120 remains stationary with respect to drilling deck 14 as racks 200A, 200B are independently transitioned between the storage positions and the loading/unloading positions.

As best shown in FIG. 12, rack unit 100 includes three pipe joint storage locations 101A, 101B, 101C, and thus, can store up to three pipe joints 20 within housing 120 at the same time. A first storage location 101A is defined by guides 210, 220 of rack 200A, a second storage location 101B is defined by guides 210, 220 of rack 200B, and a third storage location 101C is defined by centralizing plates 216 of both racks 200A, 200B when racks 200A, 200B are each in their storage position. In FIG. 12, each storage location 101A, 101B, 101C is empty (i.e., no pipe joints 20 are disposed in any of the storage locations 101A, 101B, 101C); in FIGS. 13 and 14, one pipe joint 20 is disposed in storage location 101A, however, remaining storage locations 101B, 101C are empty; in FIGS. 15 and 16, one pipe joint 20 is disposed in each storage location 101A, 101B, however, remaining storage location 101C is empty; and in FIG. 17, one pipe joint 20 is disposed in each storage location 101A, 101B, 101C. Storage location 101C is preferably empty when either rack 200A, 200B is transitioned to the loading/unloading position so that the rack 200A, 200B does not interfere with a pipe joint 20 disposed in storage location 101C.

Referring now to FIGS. 12-14, to load rack 200A and associated storage location 101A with a pipe joint 20, rack 200A is transitioned to the loading/unloading position with drive units 250. When rack 200A is transitioned to the loading/unloading position, elevator 300 is positioned within housing 120 below rack 200A so as not to interfere with the rotation of rack 200A. When rack 200A is in the loading/unloading position, bodies 211, 221 of rack 200A are coaxially aligned with pipe support member 301, and slots 214, 224 of rack 200A are circumferentially aligned with extension arm 320. Next, elevator 300 is advanced axially upward with elevator drive 350—pipe support member 301 move axially upward through bodies 211, 221 of rack 200A and extension arm 320 moves through slots 214, 224 of rack 200A. As pipe support member 301 moves upward through body 221, it axially abuts and carries cradle 230 upward through the remainder of body 211 and body 221. Elevator 300 is advanced upward until it is positioned in tubular body 211. Next, a pipe handling device on drill deck 14 lowers one pipe joint 20 axially downward through centralizer 150 into tubular body 211 of rack 200A and sets the lower end of the pipe joint 20 on cradle 230 and pipe support member 301 therein. The pipe handling device releases the pipe joint 20, which is held in a generally vertical upright orientation by upper guide 210 of rack 200A and centralizer 150. Support member 301 is then moved downward through bodies 211, 221, thereby lowering the pipe joint 20 into storage location 101A. The vertical upright orientation of pipe joint 20 is maintained as it is lowered through upper guide 210 of rack 200A and centralizer 150. Elevator 300 is moved axially downward until support member 301 exits tubular body 221 of rack 200A. As pipe support member 301 moves downward out of body 221, cradle 230 is seated against flange 223 within body 221, thereby preventing the pipe joint 20 disposed within rack 200A from falling through lower end 221*b*. With cradle 230 seated against flange 223, the upper end of pipe joint 20 may be disposed at any vertical position within upper guide 210 of rack 200A. Consequently, storage location 101A and, more generally rack unit 100, may accommodate pipe joints (e.g., pipe joints 20) of various lengths without adjustment or modification. With pipe joint 20 disposed within storage location 101A of rack 200A and elevator 300 positioned below lower guide 220, the upper end of the pipe joint 20 is positioned below centralizer 150 and rack 200A may be transitioned to the storage position.

Referring now to FIGS. 14-16, rack 200B and associated storage location 101B are loaded with a pipe joint 20 in a similar manner. In particular, rack 200B is transitioned to the loading/unloading position with drive units 250. When rack 200B is transitioned to the loading/unloading position, elevator 300 is positioned within housing 120 below rack 200B so as not to interfere with the rotation of rack 200B. When rack 200B is in the loading/unloading position, bodies 211, 221 of rack 200B are coaxially aligned with pipe support member 301, and slots 214, 224 of rack 200B are circumferentially aligned with extension arm 320. Next, elevator 300 is advanced axially upward with elevator drive 350—pipe support member 301 move axially upward through bodies 211, 221 of rack 200B and extension arms 514 moves through slots 214, 224 of rack 200B. As pipe support member 301 moves upward through body 221, it axially abuts and carries cradle 230 upward through the remainder of body 211 and body 221. Elevator 300 is advanced upward until it is positioned in tubular body 211. Next, a pipe handling device on drill deck 14 lowers one pipe joint 20 axially downward through centralizer 150 into tubular body 211 of rack 200B and sets the lower end of the pipe joint 20 on cradle 230 and pipe support member 301 therein. The pipe handling device releases the pipe joint 20, which is held in a generally vertical upright orientation by upper guide 210 of rack 200B and centralizer 150. Support member 301 is then moved downward through bodies 211, 221, thereby lowering the pipe joint 20 into storage location 101B. The vertical upright orientation of pipe joint 20 is maintained as it is lowered through upper guide 210 of rack 200B and centralizer 150. Elevator 300 is moved axially downward until support member 301 exits tubular body 221 of rack 200B. As pipe support member 301 moves downward out of body 221, cradle 230 is seated against flange 223 within body 221, thereby preventing the pipe joint 20 disposed within rack 200B from falling through lower end 221*b*. With cradle 230 seated against flange 223, the upper end of pipe joint 20 may be disposed at any vertical position within upper guide 210 of rack 200B. Thereby, storage location 101B and, more generally rack unit 100, may accommodate pipe joints (e.g., pipe joints 20) of various lengths without adjustment or modification. With pipe joint 20 disposed within storage location 101B of rack 200B and elevator 300 positioned below lower guide 220, the upper end of the pipe joint 20 is positioned below centralizer 150 and rack 200B may be transitioned to the storage position.

Figure 17:
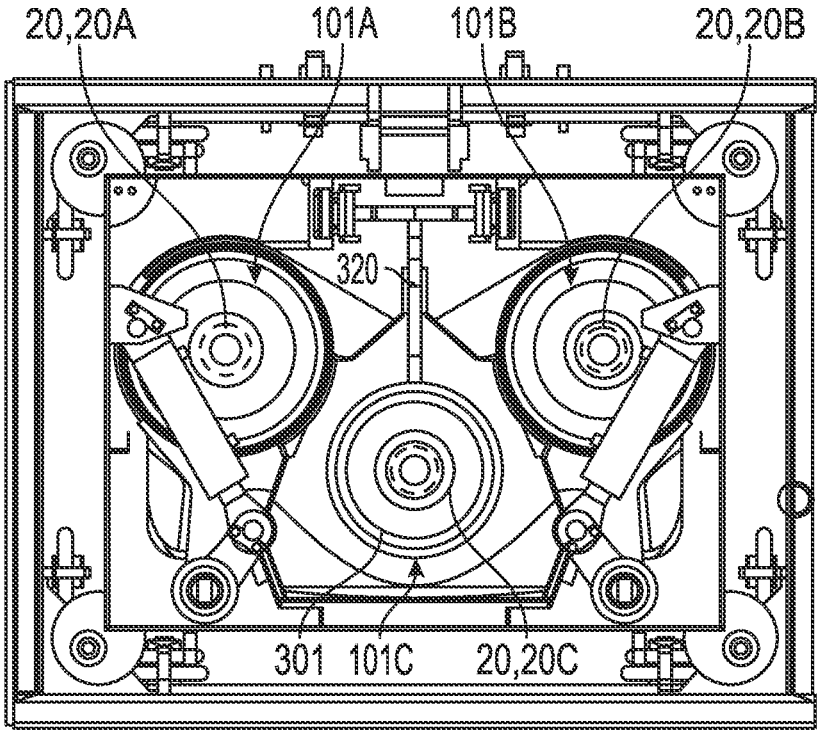

Referring now to FIGS. 16 and 17, to load a pipe joint 20 into storage location 101C, each rack 200A, 200B is disposed in its storage location, and elevator 300 is advanced axially upward with elevator drive 350. Elevator 300 is advanced upward to a position between ends 120*a*, 120*b* of housing 120. Next, a pipe handling device on drill deck 14 lowers one pipe joint 20 axially downward through centralizer 150 into storage location 101C and sets the lower end of the pipe joint 20 on pipe support member 301 of elevator 300. The pipe handling device releases the pipe joint 20, which is held in a generally vertical upright orientation by centralizer 150. Support member 301 is then moved downward through housing 120, thereby lowering the pipe joint 20 into storage location 101C. Centralizer 150 is used to hold the pipe joint 20 in a vertical upright orientation within storage location 101C with the lower end of the pipe joint 20 being held by pipe support member 301. The pipe joint 20 in storage location 101C is preferably not lowered completely below centralizer 150. In other words, the upper end of the pipe joint 20 in storage location 101C preferably extends through passage 155 of centralizer 150. Thus, when pipe support member 301 supports a pipe joint 20 in storage location 101C (i.e., supporting a pipe joint 20 not disposed in either rack 200A, 200B), pipe support member 301 is preferably not lowered axially below racks 200A, 200B. Pipe support member 301 may be stopped at any vertical position, preferably above racks 200A, 200B. Therefore, storage location 101C and, more generally rack unit 100, may accommodate pipe joints of various lengths without adjustment or modification.

Referring now to FIGS. 1 and 12-17, the following operational steps may be performed to assembly pipe stand 22 comprising four pipe joints 20 using rack unit 100. For purposes of clarity, pipe joint 20 in storage location 101A may be referred to as pipe joint 20A, pipe joint 20 in storage location 101B may be referred to as pipe joint 20B, and pipe joint 20 in storage location 101C may be referred to as pipe joint 20C. First, rack unit 100 is loaded with three pipe joints 20A, 20B, 20C as previously described. Next, a pipe handling device on drilling deck 14 lifts a pipe joint 20, referred to as pipe joint 20D, from first storage unit 21, coaxially aligns the pipe joint 20D with pipe joint 20C disposed in storage location 101C, and lowers pipe joint 20D until its lower end axially abuts the upper end of pipe joint 20C. Next, the ends of pipe joints 20C, 20D are threaded together to form a two pipe joint stand. Together the coupled pipe joints 20C, 20D are lifted from rack unit 100 through centralizer and mousehole 17 in drilling deck 14. Next, with storage location 101C empty, rack 200B (or optionally 300A) is rotated from its storage position to its loading/unloading position, and elevator 300 is employed to raise pipe joint 20B (or optionally pipe joint 20A) until a sufficient portion of pipe joint 20B extends through passage 155 above drilling deck 14. Coupled pipe joints 20C, 20D are then coaxially aligned with pipe joint 20B, lowered until the lower end of pipe joint 20C axially abuts the upper end of pipe joint 20B, and threaded onto upper end of pipe joint 20B to form a three pipe joint stand. The process is then generally repeated to connect the three pipe joint stand comprising pipe joints 20B, 20C, 20D with pipe joint 20A held in rack 200A to form the four pipe joint stand 22, which may be moved to centerline 15 and added to the drill string 18 or temporality stored in storage unit 23. In the manner described, rack unit 100 is used to store three pipe joints 20 below the drill deck 14 for the ultimate construction of pipe stand 22. The four individual pipe joints 20A, 20B, 20C, 20D are threaded together end-to-end to form stand 22. In general, any equipment known in the art such as tongs or clamps may be used to facilitate the threading of any two or more pipe joints 20.

When operating racking unit 100, some modifications to (a) the sequence of the steps, (b) the number of steps performed, (c) the distance of travel of some members, and (d) other factors may be made with a similar or another beneficial conclusion. Other operations and processes of rack unit 100 follow procedures similar to those performed for assembling a stand of four pipe joints 20. Other operations include, without limitation, (a) installing or removing a single pipe joint 20, (b) installing or removing more than one pipe joint 20, (c) assembling a stand of two pipe joints 20, and (d) assembling a stand of three pipe joints 20. Racking unit 100 may also be employed to assist in pipe stand disassembly operations, which are generally, the reverse order of assembly operations.

Figure 18:
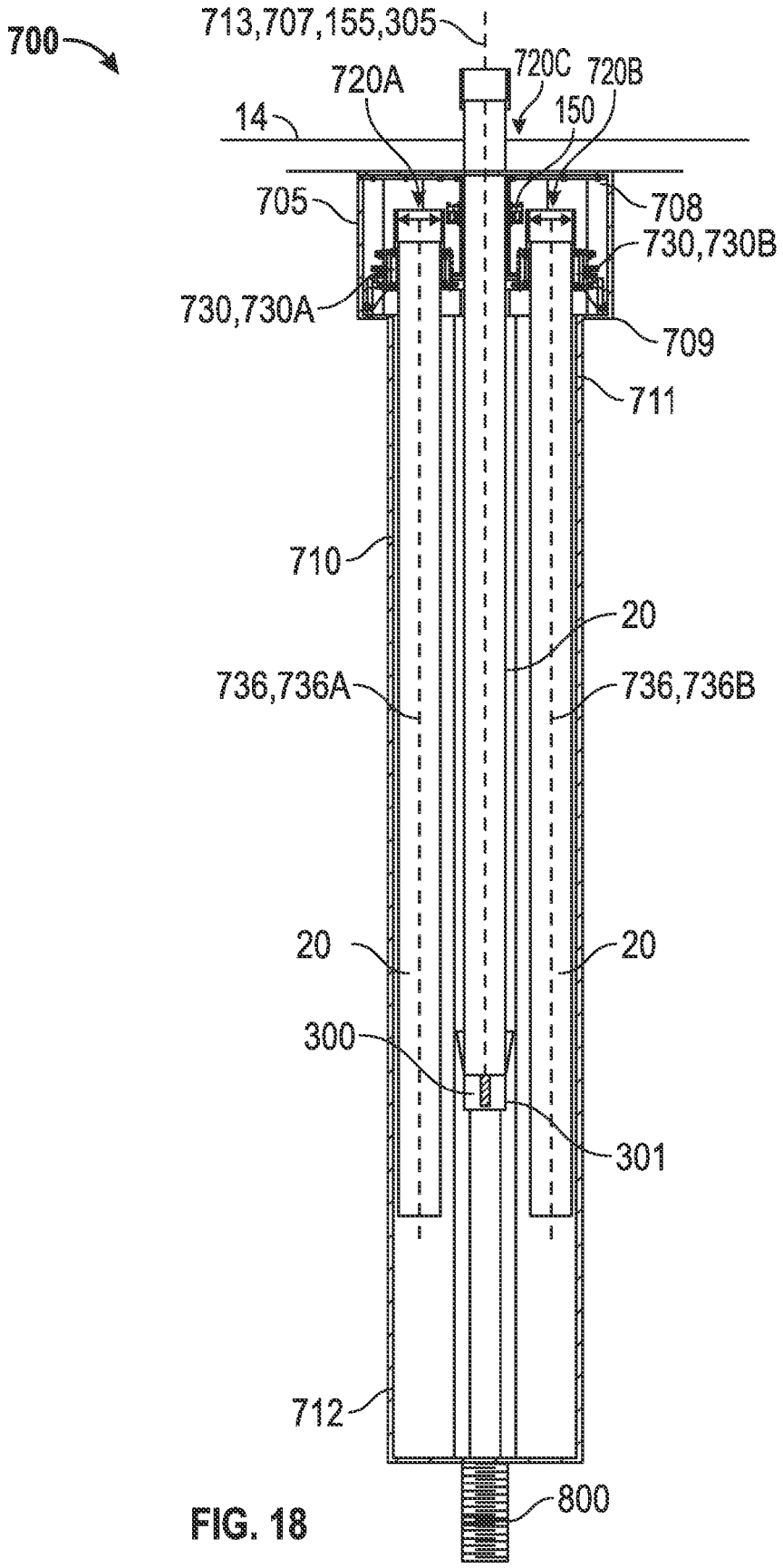
FIG. 18 is a sectional elevation view of a second embodiment of a rack unit for assembling and disassembling pipe stands as may be applied in the drilling system of FIG. 1.

Referring now to FIG. 18, another embodiment of a rack unit 700 that may be used in the place of rack unit 100 in drilling system 10 is shown. In this embodiment, rack unit 700 includes a mounting frame 705 secured to the underside of drill deck 14, a main body or housing 710 hung from frame 705, a pair of racks 730 slidingly disposed in housing 710, and an elevator 300 as previously described moveably disposed in housing 710. Each rack 730 operates to receive and temporarily store one pipe joint 20 that is used in the assembly of a pipe stand 22. In other words, each rack 730 defines a pipe storage location within housing 710. Consequently, racks 730 may also be referred to herein as pipe joint storage assemblies. A third pipe joint 20 having its lower end supported by elevator 300 may be stored in rack unit 700 between racks 730. In other words, the space within housing 710 between racks 730 may function as an additional pipe storage location within housing 710. Thus, in this embodiment, rack unit 700 can temporarily store up to three individual pipe joints at any given time—one pipe joint 20 can be stored in each rack 730, and one pipe joint 20 can be stored between racks 730. The three pipe storage locations, designated by reference numerals 720A, 720B, 720C, will be described in more detail below.

Housing 710 is an elongate tubular structure having a central or longitudinal axis 713, a first or upper end 711, and a second or lower end 712 opposite end 711. Upper end 711 is attached to mounting frame 705, thereby coupling housing 710 to deck 14, and lower end 712 is distal deck 14. In some embodiments, a shock absorber 800 is coupled to housing 710 at lower end 712, thereby preventing pipe joints 20 from falling completely through end 712. A centralizer 150 as previously described is positioned within mounting frame 705 axially adjacent upper end 711 and serves as the entry and exit location for pipe joints 20 loaded into and unloaded from housing 710. In general, centralizer 150 facilitates the vertical orientation of each pipe joint 20 (i.e., parallel to axis 713) being loaded into and unloaded from housing 710.

Referring still to FIG. 18, mounting frame 705 couples the rack unit 700 to drilling deck 14. In this embodiment, mounting frame 705 comprises a generally rectangular housing 706 having a central or longitudinal axis 707 coaxially aligned with axis 713, an open upper end 708, and an open lower end 709. Upper end 711 of housing 710 is coaxially received by housing 706 and secured therein with a plurality of bolts or other fasteners. Although a distinct and separate mounting frame 705 is employed to couple housing 710 to deck 14 in this embodiment, in other embodiments, the mounting assembly (e.g., mounting frame 705) may be integral with the upper end of the main body (e.g., housing 710), or the main body may be directly secured to the drilling deck.

Figure 19:
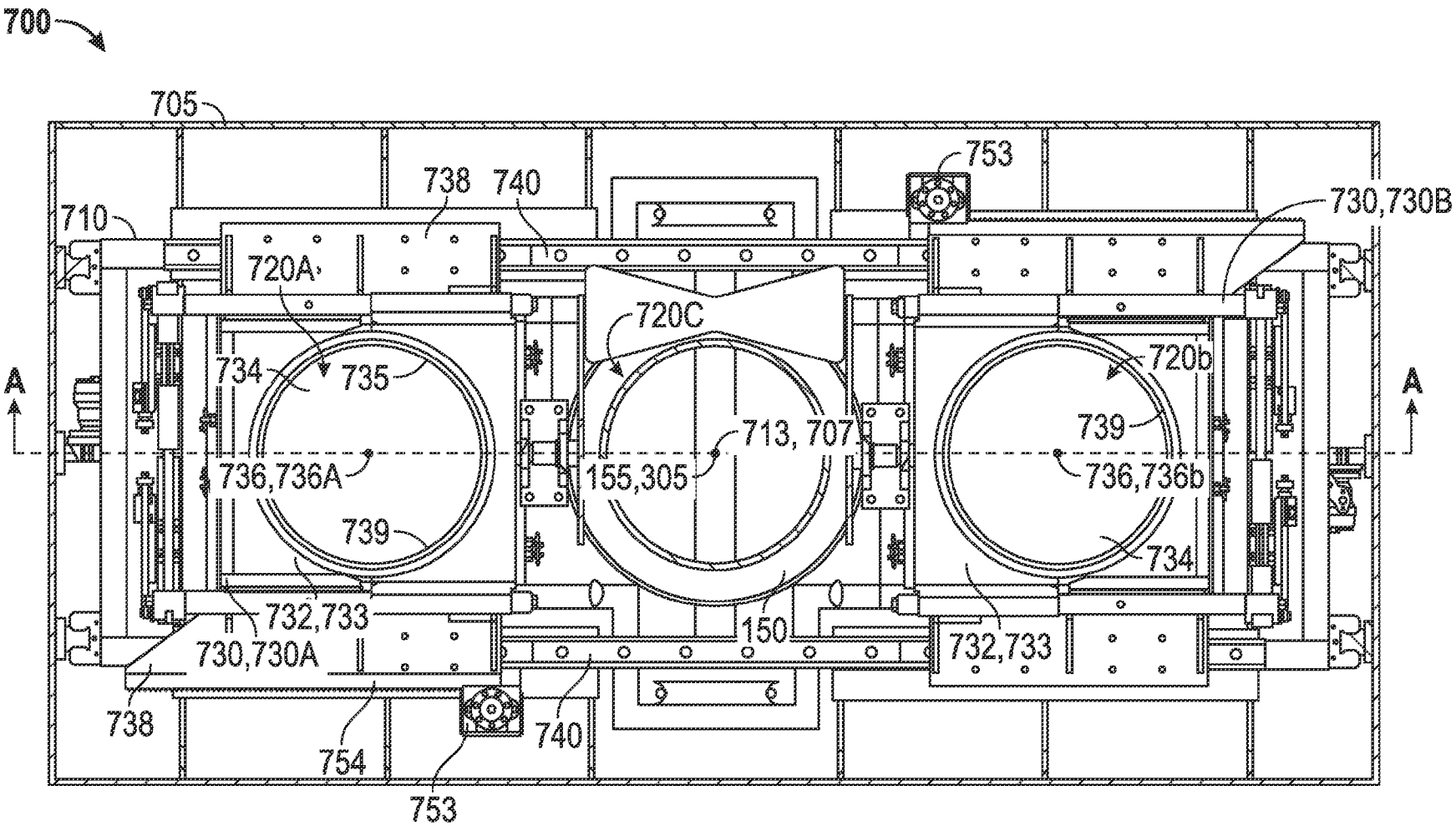
FIG. 19 is a top view of the rack unit in FIG. 18.

Referring now to FIG. 19, rack unit 700 include an elevator drive 350 as previously described, which may be disposed within housing 710 or may be external housing 710. Elevator drive 350 is configured to move elevator 300 axially up and down within housing 710 between a first or upper position proximal upper end 711 and a second or lower position proximal lower end 712. Elevator 300 is transitioned between the upper and lower positions with drive 350 during the loading and unloading of individual pipe joints 20. Although elevator 300 is described as having upper and lower positions within housing 710, it should be appreciated that elevator 300 may be stopped and positioned at any desired axial position within housing 710.

Referring again to FIG. 18, as previously described, rack unit 700 includes two racks 730. Each rack 730 is moveably disposed in housing 710 and is configured to receive one pipe joint 20, temporarily store the pipe joint 20, and then supply the stored pipe joint 20 during assembly of a pipe stand 22. In particular, each rack 730 is independently linearly moved between a pipe joint loading/unloading position coaxially aligned with axes 155, 305, and a pipe joint storage position laterally offset and radially spaced apart from axes 155, 305 and elevator 300. In the loading/unloading position, rack 730 is positioned to receive a pipe joint 20 lowered through passage 154 in centralizer 150 (if a pipe joint 20 is not already disposed in rack 730) or supply a pipe joint 20 through passage 154 (if a pipe joint 20 is already disposed in rack 730); and in the storage position, rack 730 is positioned so as to not interfere with elevator 300 as it moves axially up and down during the loading or unloading of a pipe joint into a different storage location (e.g., into the other rack 730). It should be appreciated that only one rack 730 can be disposed at the loading/unloading position at a particular time.

Referring now to FIGS. 18 and 19, in this embodiment, each rack 730 comprises a guide head 732, a pipe support insert 739, and a pair of rails or tracks 740. Guide head 732 includes an upper end 733, central through-bore 734 with a central axis 736, a plurality of rail coupling members 738, and an annular pipe support insert 739 coaxially disposed within through-bore 734. Insert 739 comprises a central through-bore 735 that slidingly receives a pipe joint 20. The inner diameter of bore 735 is less than the outer diameter of the box end or a shoulder of a pipe joint 20 but is greater than the outer diameter of the shaft diameter of the pipe joint. In general, insert 739 may be removed and replaced with another insert having a different inner diameter to accommodate different sizes of pipe joints. Each pipe support insert 739 has a bore diameter appropriate to match the shaft diameter of a particular size of pipe joint 20.

As best shown in FIG. 19, two rail coupling members 738 on opposite sides of collar 733 extend across and slidingly engage rails 740. The underside of each shoulder includes a friction-reducing wear element (not shown) or rolling wheels (not shown) to contact rails 740. A gear rack 754 affixed to a shoulder 738 of each of the two rack collars 732. Two motorized pinion gears 753 are coupled within housing 710 or mounting frame 705. One pinion gear 753 meshes the gear rack 754 on each of the two pipe racks 730. Therefore, each pipe rack 730 may be linearly actuated between a storage position and loading/unloading position by the motorized pinion gear 753 that meshes with the gear rack 754 coupled to pipe support inserts 739. In at least one embodiment, a hydraulic cylinder is configured to move racks 730.

Referring now to FIGS. 18 and 19, the operation of rack unit 700 will now be described. For purposes of explanation, the rack 730 on the left of rack unit 700 will be referred to as rack 730A, and the rack 730 on the right of rack unit 700 will be referred to as rack 730B. In FIG. 18, rack 730A is in its storage position laterally offset and spaced apart from axis 155 of centralizer 150 and axis 305 of pipe support member 301. In FIG. 18, rack 730B is also in its storage position laterally offset and spaced apart from axes 155, 305. Racks 730A, 730B share a common loading/unloading position, which corresponds to collar central axis 736A, 736B, respectively, being aligned with axes 155, 305. Only one rack 730A, 730B may occupy loading/unloading position at any given time. During other times, neither 730A, 730B will occupy loading/unloading position. Elevator 300 is preferably positioned in the lower end of housing 710 below racks 730A, 730B when either rack 730A, 730B is transitioned between the storage position and the loading/unloading position to avoid interference therebetween. It should be appreciated that housing 710 remains stationary with respect to drilling deck 14 as racks 730A, 730B are independently transitioned between the storage positions and the loading/unloading positions.

As best shown in FIG. 18, rack unit 700 includes three pipe joint storage locations 720A, 720B, 720C, and thus, can store up to three pipe joints 20 within housing 710 at the same time. A first storage location 720A is defined by guide head 732 of rack 730A, a second storage location 720B is defined by guide head 732 of rack 730B, and a third storage location 720C is defined by centralizer 150. In FIG. 18, one pipe joint 20 is disposed in each storage location 720A, 720B, 720C. Storage location 720C is preferably empty when either rack 730A, 730B is transitioned to the loading/unloading position so that the rack 730A, 730B does not interfere with a pipe joint 20 disposed in storage location 720C.

Referring now to FIGS. 18 and 19 and assuming each storage location 280A, 280B, 280C is empty (i.e., no pipe joints 20 are disposed in any of the storage locations 280A, 280B, 280C), to load rack 730A and associated storage location 720A with a pipe joint 20, rack 730A is transitioned to the loading/unloading position with drive unit 750. When rack 730A is transitioned to the loading/unloading position, elevator 300 is positioned within housing 710 below rack 730A so as not to interfere with the rotation of rack 730A. When rack 730A is in the loading/unloading position, bodies 310, 410 of rack 730A are coaxially aligned with pipe support member 301. Next, elevator 300 with support member 301 is advanced axially upward until it is positioned at a preferred distance below centralizer 150 and upper end 711 of housing 710. Next, a pipe handling device on drill deck 14 lowers one pipe joint 20 axially downward through centralizer 150 and sets the lower end of the pipe joint 20 on pipe support member 301. The pipe handling device releases the pipe joint 20, which is held in a generally vertical upright orientation by guide head 732 of rack 730A and centralizer 150. Pipe support member 301 is then moved downward thereby lowering the pipe joint 20 into storage location 720A. The vertical upright orientation of pipe joint 20 is maintained as it is lowered through guide head 732 of rack 730A and centralizer 150. Elevator 300 is moved axially downward until pipe joint 20 is fully supported by holding or pipe support inserts 739 in guide head 732.

As elevator 300 continues to move downward, support member 301 releases pipe joint 20. The holding member 739 in guide head 732 prevents the pipe joint 20 disposed within rack 730A from falling to lower end 712 of housing 710. With pipe joint 20 disposed within storage location 720A of rack 730A and elevator 300 positioned below pipe joint 20, the upper end of the pipe joint 20 is positioned below centralizer 150, and rack 730A may be transitioned to the storage position.

Referring still to FIG. 18, rack 730B and associated storage location 720B are loaded with a pipe joint 20 in a similar manner. In particular, rack 730B is transitioned to the loading/unloading position with drive unit 750. When rack 730B is transitioned to the loading/unloading position, elevator 300 is positioned within housing 710 below rack 730B so as not to interfere with the rotation of rack 730B. When rack 730B is in the loading/unloading position, guide head 732 of rack 730B is coaxially aligned with pipe support member 301. Next, support member 301 is advanced axially upward until it is positioned at a preferred distance below centralizer 150 and upper end 711 of housing 710. Next, a pipe handling device on drill deck 14 lowers one pipe joint 20 axially downward through centralizer 150 and sets the lower end of the pipe joint 20 on pipe support member 301. The pipe handling device releases the pipe joint 20, which is held in a generally vertical upright orientation by guide head 732 of rack 730B and centralizer 150. Pipe support member 301 is then moved downward thereby lowering the pipe joint 20 into storage location 720A. The vertical upright orientation of pipe joint 20 is maintained as it is lowered through guide head 732 of rack 730B and centralizer 150. Pipe support member 301 is moved axially downward until pipe joint 20 is fully supported by holding or pipe support insert 739 in guide head 732.

As elevator 300 continues to move downward, support member 301 releases pipe joint 20. The pipe support insert 739 in guide head 732 prevents the pipe joint 20 disposed within rack 730B from falling to lower end 712 of housing 710. With pipe joint 20 disposed within storage location 720A of rack 730B and elevator 300 positioned below pipe joint 20, the upper end of the pipe joint 20 is positioned below centralizer 150, and rack 730B may be transitioned to the storage position.

Referring now to FIGS. 18 and 19, to load a pipe joint 20 into storage location 720C, each rack 730A, 730B is disposed in its storage location, and elevator 300 is advanced axially upward with elevator drive 350. Elevator 300 is advanced upward to a position between ends 711, 712 of housing 710. Next, a pipe handling device on drill deck 14 lowers one pipe joint 20 axially downward through centralizer 150 into storage location 720C and sets the lower end of the pipe joint 20 on pipe support member 301. The pipe handling device releases the pipe joint 20, which is held in a generally vertical upright orientation by centralizer 150. Support member 301 is then moved downward through housing 710, thereby lowering the pipe joint 20 into storage location 720C. Centralizer 150 is used to hold the pipe joint 20 in a vertical upright orientation within storage location 720C with the lower end of the pipe joint 20 being held by pipe support member 301. The pipe joint 20 in storage location 720C (i.e., not disposed in either rack 730A, 730B) is preferably not lowered completely below centralizer 150. In other words, the upper end of the pipe joint 20 in storage location 720C preferably extends through passage 161 of centralizer 150. When pipe support member 301 supports a pipe joint 20 in storage location 720C, pipe support member 301 is preferably not lowered to its lowest possible location. Thus, pipe support member 301 continues to support the pipe joint 20 in storage location 720C.

The following operational steps may be performed to assembly pipe stand 22 comprising four pipe joints 20 using rack unit 700. For purposes of clarity, pipe joint 20 in storage location 720A may be referred to as pipe joint 20A, pipe joint 20 in storage location 720B may be referred to as pipe joint 20B, and pipe joint 20 in storage location 720C may be referred to as pipe joint 20C. First, rack unit 700 is loaded with three pipe joints 20A, 20B, 20C as previously described. Next, a pipe handling device on drilling deck 14 lifts a pipe joint 20, referred to as pipe joint 20D, from first storage unit 21, coaxially aligns the pipe joint 20D with pipe joint 20C disposed in storage location 720C, and lowers pipe joint 20D until its lower end axially abuts the upper end of pipe joint 20C. Next, the ends of pipe joints 20C, 20D are threaded together to form a two pipe joint stand. Together the coupled pipe joints 20C, 20D are lifted from rack unit 700 through centralizer and mousehole 17 in drilling deck 14. Next, with storage location 720C empty, rack 730B (or optionally 730A) is linearly moved from its storage position to its loading/unloading position, and elevator 300 is employed to raise pipe joint 20B (or optionally pipe joint 20A) until a sufficient portion of pipe joint 20B extends through passage 161 above drilling deck 14. Coupled pipe joints 20C, 20D are then coaxially aligned with pipe joint 20B, lowered until the lower end of pipe joint 20C axially abuts the upper end of pipe joint 20B, and threaded onto upper end of pipe joint 20B to form a three pipe joint stand. The process is then generally repeated to connect the three pipe joint stand comprising pipe joints 20B, 20C, 20D with pipe joint 20A held in rack 730A to form the four pipe joint stand 22, which may be moved to centerline 15 and added to the drill string 18 or temporality stored in storage unit 23. In the manner described, rack unit 700 is used to store three pipe joints 20 below the drill deck 14 for the ultimate construction of pipe stand 22. The four individual pipe joints 20A, 20B, 20C, 20D are threaded together end-to-end to form stand 22. In general, any equipment known in the art such as tongs or clamps may be used to facilitate the threading of any two or more pipe joints 20.

When operating rack unit 700, some modifications to (a) the sequence of the steps, (b) the number of steps performed, (c) the distance of travel of some members, and (d) other factors may be made with a similar or another beneficial conclusion. Other operations and processes of rack unit 700 follow procedures similar to those performed for assembling a stand of four pipe joints 20. Other operations include, without limitation, (a) installing or removing a single pipe joint 20, (b) installing or removing more than one pipe joint 20, (c) assembling a stand of two pipe joints 20, and (d) assembling a stand of three pipe joints 20. Rack unit 700 may also be employed to assist in pipe stand disassembly operations, which are generally, the reverse order of assembly operations.

Although embodiments of rack units described herein (e.g., rack unit 100, 700) have been shown and described as being used in conjunction with offshore drilling systems (e.g., system 10), it is to be understood that such embodiments of rack units may also be used in conjunction with land based drilling systems. Further, although embodiments of rack units described herein have been shown and described as being used to receive and temporarily store individual pipe joints (e.g., pipe joints 20) used to construct pipe stands (e.g., pipe stands 22) for inclusion in a drill string, it should be appreciated that any tubular (e.g., casing section, collars, etc.) can be received and stored within the racks units. In other words, embodiments described herein are not limited to the temporary storage of pipe joints.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simply subsequent reference to such steps.

What is claimed is:

1. A rack unit for storing one or more tubulars through a hole offset from a wellbore centerline on a drilling deck, the rack unit comprising:

a tubular housing having a longitudinal axis, an upper end, and a lower end opposite the upper end;

a first rack disposed within the housing, wherein the first rack is moveably coupled to the housing;

a second rack disposed within the housing, wherein the second rack is moveably coupled to the housing;

wherein the first rack is configured to move within the housing between a transfer position and a first storage position laterally offset from the transfer position;

wherein the second rack is configured to move within the housing independent of the first rack between the transfer position and a second storage position laterally offset from the transfer position, and wherein the second storage position is laterally offset from the first storage position;

wherein each tubular is configured to be loaded into the tubular housing through the transfer position and unloaded from the tubular housing through the transfer position.

2. The rack unit of claim 1, wherein the tubular housing of the rack unit is stationary with respect to the drilling deck.

3. The rack unit of claim 1, wherein the rack unit further comprises:

an elevator disposed in the housing, wherein the elevator is configured to be moved axially up and down relative to the housing.

4. The rack unit of claim 3, wherein the first rack has a first position coaxially aligned with a support member of the elevator and a second position radially offset from the support member;

wherein the second rack has a first position coaxially aligned with a support member of the elevator and a second position radially offset from the support member.

5. The rack unit of claim 1, wherein the first rack is pivotally coupled to the housing and is configured to rotate about a first axis that is parallel to the longitudinal axis of the housing and radially offset from the longitudinal axis of the housing;

wherein the second rack is pivotally coupled to the housing and is configured to rotate about a second axis that is parallel to the longitudinal axis of the housing and radially offset from the longitudinal axis of the housing and from the first axis.

6. The rack unit of claim 5, wherein each rack comprises:

an upper guide and a lower guide axially positioned below the upper guide;

wherein the upper guide comprises a tubular body having a central axis, an upper end, a lower end, and a through slot extending axially between the upper end and the lower end;

wherein the lower guide comprises a tubular body having a central axis coaxially aligned with the central axis of the upper guide, an upper end, a lower end, and a through slot extending axially between the upper end and the lower end.

7. The rack unit of claim 6, wherein each rack comprises a cradle moveably disposed in the tubular body of the lower guide, wherein each cradle is configured to receive the lower end of a tubular and is seated on an annular shoulder in the lower end of the tubular member of the corresponding lower guide.

8. The rack unit of claim 7, wherein the rack unit further comprises an elevator disposed in the housing, wherein the elevator is configured to be moved axially up and down relative to the housing;

wherein the elevator includes a cup-shaped support member configured to receive the lower end of a tubular and an extension arm extending radially from the support member;

wherein the tubular body of each upper guide and the tubular body of each lower guide is configured to slidingly receive the support member;

wherein the slot in each upper member and the slot in each lower member is configured to slidingly receive the extension arm.

9. The rack unit of claim 1, further comprising:

a mounting assembly attached to the drilling deck and the upper end of the housing;

a capture basket disposed at the lower end of the housing and configured to catch a tubular falling through the lower end of the housing.

10. The rack unit of claim 9, further comprising a plurality of circumferentially spaced connecting lines suspending the capture basket from the mounting assembly.

11. The rack unit of claim 1, wherein the first rack is configured to move while the second rack is in the second storage position, and the second rack is configured to move independently of the first rack while the first rack is in the first storage position.

12. The rack unit of claim 1 wherein the rack unit is coupled to and extends downward from the drilling deck; and wherein the rack unit is configured for loading and unloading one or more tubulars through a hole in the drilling deck.

13. A method for constructing a pipe stand, the method comprising:

(a) positioning a rack unit below a hole in a drilling deck, wherein the rack unit comprises a tubular housing having a longitudinal axis, a first rack disposed in the housing, a second rack disposed in the housing, and an elevator disposed in the housing;

(b) moving the first rack relative to the housing from a first position laterally offset from the elevator to a second position coaxially aligned with the elevator;

(c) moving the elevator axially upward through at least a portion of the first rack;

(d) inserting a first pipe joint through the hole into the first rack;

(e) supporting the first pipe joint in the first rack with the elevator; and (f) lowering the first pipe joint into the first rack with the elevator;

(g) moving the second rack from a third position laterally offset from the elevator to the second position coaxially aligned with the elevator; wherein the movement of the second rack is independent of the movement of the first rack.

14. The method of claim 13, further comprising:

maintaining the first rack in the second position during (d), (e), and (f).

15. The method of claim 14, further comprising:

moving the first rack from the second position to the first position with the first pipe joint therein after (d), (e), and (f) and before (g).

16. The method of claim 15, further comprising:

(h) moving the elevator axially upward through at least a portion of the second rack;

(i) inserting a second pipe joint through the hole into the second rack;

(j) supporting the second pipe joint in the second rack with the elevator; and (k) lowering the second pipe joint into the second rack with the elevator.

17. The method of claim 16, further comprising:

maintaining the second rack in the second position during (h), (i), (j), and (k).

18. The method of claim 17, further comprising:

moving the second rack from the second position to the third position with the second pipe joint therein after (k).

19. The method of claim 17, further comprising:

(l) moving the elevator axially upward in the housing of the rack unit between the first rack and the second rack;

(m) inserting a third pipe joint through the hole into the housing of the rack unit;

(n) supporting the third pipe joint in the housing of the rack unit with the elevator; and (o) lowering the third pipe joint into the housing of the rack unit with the elevator.

20. The method of claim 17, wherein (b) comprises rotating the first rack relative to the housing about a first axis of rotation that is offset from the longitudinal axis of the housing from the first position to the second position;

wherein (g) comprises rotating the second rack relative to the housing about a second axis of rotation that is offset from the longitudinal axis of the housing from the third position to the second position.

21. The method of claim 20, wherein each rack comprises an upper tubular guide and a lower tubular guide;

wherein the first rack is rotated between the first position and the second position by a first actuator that rotates the upper tubular guide of the first rack and a second actuator that rotates the lower tubular guide of the first rack;

wherein the second rack is rotated between the third position and the second position by a third actuator that rotates the upper tubular guide of the second rack and a fourth actuator that rotates the lower tubular guide of the second rack.

22. The method of claim 21, wherein the first actuator and the second actuator are synchronized to rotate the upper tubular guide and the lower tubular guide of the first rack together; and wherein the third actuator and the fourth actuator are synchronized to rotate the upper tubular guide and the lower tubular guide of the second rack together.

23. The method of claim 14, wherein (b) comprises moving the first rack linearly from the first position to the second position.

24. The method of claim 14, wherein (b) comprises rotating the first rack relative to the housing about a first axis of rotation that is offset from the longitudinal axis of the housing from the first position to the second position.

25. A system for storing one or more tubulars, the system comprising:

a drilling deck including a hole offset from a wellbore centerline;

a rack unit coupled to the drilling deck and extending downward from the hole in the drilling deck;

wherein the rack unit comprises:

a housing having a vertical longitudinal axis, an upper end, and a lower end opposite the upper end;

a first rack disposed within the housing and configured to receive a tubular, wherein the first rack includes a first upper guide pivotally coupled to the housing and a first lower guide pivotally coupled to the housing, wherein the first upper guide and the first lower guide of the first rack are configured to pivot about a first rotational axis;

a second rack disposed within the housing and configured to receive a tubular, wherein the second rack includes a second upper guide pivotally coupled to the housing and a second lower guide pivotally coupled to the housing, wherein the second upper guide and the second lower guide of the second rack are configured to pivot about a second rotational axis that is parallel to and offset from the first rotational axis; and an elevator disposed within the housing and configured to move axially up and down within the housing;

wherein the first rack is configured to rotate between a first storage position and a transfer position;

wherein the second rack is configured to rotate between a second storage position and the transfer position independent of the first rack; and wherein the first rack and the second rack are configured to occupy the transfer position separately.

26. The system of claim 25, wherein the upper guide of the first rack comprises a tubular body and the lower guide of the first rack comprises a tubular body coaxially aligned with the tubular body of the upper guide of the first rack.

27. The system of claim 26, wherein the tubular body of the upper guide of the first rack has an upper end, a lower end, and a slot extending axially from the upper end to the lower end; and wherein the tubular body of the lower guide of the first rack has an upper end, a lower end, and a slot extending axially from the upper end to the lower end.

28. The system of claim 25, wherein the upper guide of the second rack comprises a tubular body and the lower guide of the second rack comprises a tubular body coaxially aligned with the tubular body of the upper guide of the second rack.

29. The system of claim 28, wherein the tubular body of the upper guide of the second rack has an upper end, a lower end, and a slot extending axially from the upper end to the lower end; and wherein the tubular body of the lower guide of the second rack has an upper end, a lower end, and a slot extending axially from the upper end to the lower end.

* * * * *